US012588706B2

(12) United States Patent
Wang

(10) Patent No.: US 12,588,706 B2
(45) Date of Patent: Mar. 31, 2026

(54) ATOMIZING CORE, ATOMIZER, ELECTRONIC CIGARETTE, AND ASSEMBLY METHOD

(71) Applicant: Aspire North America LLC, Venice, CA (US)

(72) Inventor: Michael Wang, Redondo Beach, CA (US)

(73) Assignee: Aspire North America LLC, Venice, NY (US)

( * ) Notice: Subject to any disclaimer, the term of this patent is extended or adjusted under 35 U.S.C. 154(b) by 413 days.

(21) Appl. No.: 18/139,205

(22) Filed: Apr. 25, 2023

(65) Prior Publication Data

US 2024/0358073 A1 Oct. 31, 2024

(51) Int. Cl.
*A24F 40/46* (2020.01)
*A24F 40/485* (2020.01)
*A24F 40/70* (2020.01)

(52) U.S. Cl.
CPC ..... *A24F 40/46* (2020.01); *A24F 40/485* (2020.01); *A24F 40/70* (2020.01)

(58) Field of Classification Search
None
See application file for complete search history.

(56) References Cited

U.S. PATENT DOCUMENTS

2016/0345629 A1* 12/2016 Mironov ..... A24F 40/42
2022/0408815 A1* 12/2022 Chen ..... A24F 40/44

FOREIGN PATENT DOCUMENTS

CN 111109666 A * 5/2020 ..... A24F 40/70
CN 112931953 A * 6/2021 ..... A24F 40/42
CN 114747806 A * 7/2022 ..... A24F 40/10
CN 217507791 U 9/2022
WO 2016082108 A1 6/2016
WO 2020107536 A1 6/2020
(Continued)

OTHER PUBLICATIONS

Translation of CN 111109666 (Year: 2020).*
(Continued)

*Primary Examiner* — Cynthia Szewczyk
(74) *Attorney, Agent, or Firm* — Harter Secrest & Emery LLP

(57) ABSTRACT

An atomizing core, an atomizer, an electronic cigarette, and an assembly method are provided. The atomizing core is used for atomizing an atomizing substrate to form an aerosol, and includes: an atomizing core housing defining an airflow inlet, an airflow outlet, an accommodating space between the airflow inlet and the airflow outlet, and at least one atomizing substrate inlet in communication with the accommodating space; an atomizing seat arranged in the accommodating space and defining an atomizing channel for being in communication with the airflow inlet and the airflow outlet, and at least one opening for communicating the at least one atomizing substrate inlet with the atomizing channel; and at least one heating sheet arranged in the atomizing channel and at least partially opposite one or more of the at least one opening respectively. Embodiments of the present disclosure can increase the degree of integration of the atomizing core, so as to increase production efficiency and product stability.

22 Claims, 28 Drawing Sheets

(56) References Cited

FOREIGN PATENT DOCUMENTS

| | | | | |
|---|---|---|---|---|
| WO | WO-2021007776 A1 * | 1/2021 | ..... | A24F 40/46 |
| WO | 2022105801 A1 | 5/2022 | | |

OTHER PUBLICATIONS

Translation of CN 114747806 (Year: 2022).*
European Patent Office, PCT International Search Report for PCT International Application No. PCT/US2023/028110, Jan. 3, 2024, Rijswijk, Netherlands.

* cited by examiner

ATOMIZING CORE, ATOMIZER, ELECTRONIC CIGARETTE, AND ASSEMBLY METHOD

TECHNICAL FIELD

The present disclosure relates to the technical field of atomization, and particularly relates to an atomizing core, an atomizer, an electronic cigarette including the atomizing core, and an assembly method for the atomizing core.

BACKGROUND

An electronic cigarette (also known as an "E-cigarette") or a vaping device is an electronic delivery system for generating an aerosol from an atomizing substrate for a user to vape.

An atomization substance may be a liquid (e.g., e-liquid, etc.) or a solid or gel (e.g., E-cigarette paste), etc.

Typically, a conventional electronic cigarette primarily includes a cartridge stored with the atomization substance, and a power supply device. The cartridge has a heating or vaporization device, such as an atomizer having an atomizing core, and the power supply device supplies power to the atomizing core to convert the atomization substance in the cartridge into an aerosol for the user to vape. For many electronic cigarettes, a puff from a user activates the atomizing core, vaporizing the liquid atomizing substrate, etc. in the cartridge, and then the user inhales a produced aerosol through a mouthpiece.

As a critical component in the electronic cigarette, the atomizing core directly affects the aerosol produced by heating atomization, thereby affecting the user's experience. The existing atomizing core has problems of high assembly difficulty, numerous and complex processes, etc.

SUMMARY

According to a first aspect of the present disclosure, an atomizing core is provided. The atomizing core is used for atomizing an atomizing substrate to form an aerosol, and includes: an atomizing core housing defining an airflow inlet, an airflow outlet, an accommodating space between the airflow inlet and the airflow outlet, and at least one atomizing substrate inlet in communication with the accommodating space; an atomizing seat arranged in the accommodating space and defining an atomizing channel for being in communication with the airflow inlet and the airflow outlet, and at least one opening for communicating the at least one atomizing substrate inlet with the atomizing channel; and at least one heating sheet arranged in the atomizing channel and at least partially opposite one or more of the at least one opening respectively.

According to another aspect of the present disclosure, an atomizer is provided. The atomizer includes the atomizing core and a housing. The atomizing core is arranged in the housing, and a storage chamber for storing an atomizing substrate is formed between the housing and the atomizing core.

According to yet another aspect of the present disclosure, an electronic cigarette is provided. The electronic cigarette includes the atomizer and a power supply assembly to supply power to the atomizer.

According to still another aspect of the present disclosure, an assembly method for the atomizing core of the present disclosure is provided. The atomizing core further includes an electrode and an absorbing material for the atomizing substrate, and an atomizing seat defines a limiting structure for inserting the electrode therein. The assembly method includes: inserting the electrode into the limiting structure of the atomizing seat; mounting at least one heating sheet and the absorbing material for the atomizing substrate into the atomizing seat; inserting the mounted atomizing seat into an accommodating space of an atomizing core housing from an airflow inlet; and injecting glue among the electrode, the atomizing seat and the atomizing core housing at the airflow inlet.

According to one or more embodiments of the present disclosure, the present disclosure provides an atomizing core. By modularly arranging components in the atomizing core, the degree of integration of the atomizing core can be increased, and the atomizing core can satisfy requirements of standardized and modular assembly, so as to increase production efficiency and product stability. Compared with a cotton heating core (requiring manually mounting cotton) or a ceramic heating core (having problems of numerous and complex procedures) in the related art, each component in the atomizing core of the present disclosure can be produced in a standardized and modular manner, and the components can be assembled automatically, so as to improve product production efficiency and stability.

BRIEF DESCRIPTION OF THE DRAWINGS

In order to explain the technical solutions in embodiments of the present disclosure more clearly, the accompanying drawings required in the description of the embodiments will be described below briefly. Apparently, the accompanying drawings in the following description show merely some embodiments of the present disclosure, and other drawings can be derived from structures as shown in these accompanying drawings by those skilled in the art without creative efforts. The drawings are as follows.

LIST OF REFERENCE NUMERALS

Figure 1:
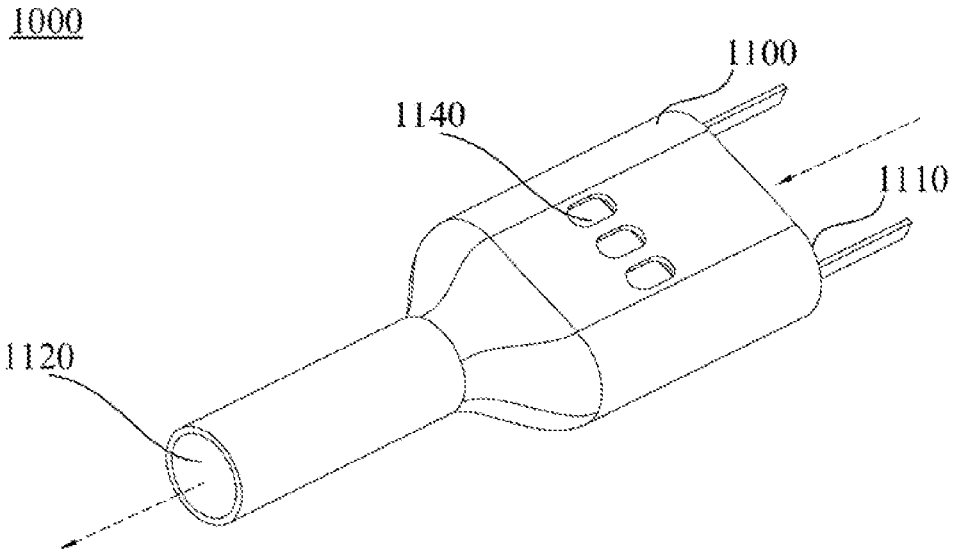
FIG. 1 is a perspective view of an atomizing core according to some embodiments of the present disclosure.

Atomizing core 1000, 2000, 3000, 4000, 5000; Atomizing core housing 1100, 2100, 3100, 4100, 5100; Airflow inlet 1110, 4110, 5110; Airflow outlet 1120; Accommodating space 1130, 2130, 3130, 4130; Atomizing substrate inlet 1140, 3140, 5140; Atomizing seat 1200, 2200, 3200, 4200, 5200; Atomizing channel 1210, 2210, 3210, 4210, 5210; Opening 1220, 3220, 4220; Projection 1230; Heating sheet 1300, 3300, 4300; Absorbing material for the atomizing substrate 1400, 3400, 4400; Electrode 1500, 2500, 3500, 4500, 5500; Extension direction L; Leak-proof material 5600;

Limiting structure 1240, 2240, 3240; Limiting channel 1241, 3241; First limiting portion 1242; Second limiting portion 1243; First protrusion 1510; Second protrusion 1520; First end 1530;

First heating sheet 2300; Second heating sheet 2300'; First absorbing material for the atomizing substrate 2400; Second absorbing material for the atomizing substrate 2400'; First atomizing substrate inlet 2140; Second atomizing substrate inlet 2140'; First opening 2220; Second opening 2220';

First electrode 3510, 4510; Second electrode 3520, 4520; Ramp 3242;

First bent portion 4511; Second bent portion 4521; Limiting structure 4240; First limiting channel 4241; Second limiting channel 4241'; Third limiting portion 4242; Fourth limiting portion 4242';

Atomizer 6000; Housing 6100; Housing body 6200; Base 6300.

DETAILED DESCRIPTION

The technical solutions of embodiments of the present disclosure will be described below clearly and comprehensively in conjunction with accompanying drawings of the embodiments of the present disclosure. Apparently, the embodiments described are merely some embodiments rather than all embodiments of the present disclosure. Based on the embodiments of the present disclosure, all other embodiments acquired by those of ordinary skill in the art without creative efforts fall within the scope of protection of the present disclosure.

It is to be noted that all directional indications (for example, up, down, left, right, front, rear, etc.) in the embodiments of the present disclosure are merely used to explain relative positional relationships, motion conditions, etc. between components in a certain specific posture (as shown in the accompanying drawings), and under the condition that the specific posture changes, the directional indications also change accordingly.

In the present disclosure, unless expressly specified otherwise, the terms "connect", "fix", etc. are to be construed broadly, for example, may mean a direct connection or an indirect connection via an intermediary medium, or may mean a communication within two elements or an interworking relationship between two elements. For those skilled in the art, the specific meaning of the above terms in the present disclosure can be understood according to specific circumstances.

The term "communication" refers to fluidic communication, that is, fluid (including liquid and/or gas) can flow from one component to another herein. Further, communication between two components can refer to direct communication between the two components, for example, at least partial alignment between two holes, or communication by means of an intermediate medium herein.

In the present disclosure, unless otherwise indicated, all numbers expressing component parameters, technical effects, and so forth used in the specification and claims are to be understood as being modified in any case by the term "about" or "substantially". Accordingly, unless indicated to the contrary, numerical parameters set forth in the following specification and attached claims are approximations. For those skilled in the art, each numerical parameter may vary depending upon the desired properties and effects sought to be obtained by the present disclosure and should be construed in light of the significant figures of digits and ordinary rounding techniques or in a manner understood by those skilled in the art.

The terms used in the description of the various examples in the present disclosure are for the purpose of describing particular examples only and are not intended to be limiting. If the number of elements is not specifically defined, there may be one or more elements, unless otherwise expressly indicated in the context. Moreover, the term "and/or" used in the present disclosure encompasses any of and all possible combinations of listed items.

The term "atomizing substrate" refers to a mixture or an auxiliary substance that can be wholly or partially atomized into an aerosol by an electronic device or similar device. The atomizing substrate may be a liquid form of medium such as an e-liquid, medical medication, skin care lotion, etc. By atomizing these media, an aerosol that can be inhaled or absorbed may be delivered to a user.

The term "aerosol" refers to a colloidal dispersion system formed from small solid or liquid particles dispersed and suspended in a gaseous medium.

The term "atomizer" refers to a device in which a stored substrate capable of being atomized, that is, an atomizing substrate forms an aerosol by means of heating or ultrasounds, etc. An atomizing core is one of the main components of the atomizer.

In the related art, with electronic cigarettes as an example, atomizing cores typically include a cotton heating core and a ceramic heating core. In the cotton heating core, a heating wire is wound around cotton generally, or the heating wire is wrapped in the cotton. In the ceramic heating core, a heating wire is embedded in an inner wall of a hollow porous ceramic. The cotton in the cotton heating core and the ceramic in the ceramic heating core are used to adsorb e-liquid, etc. and guide the same onto the heating wire, to heat and then atomize the e-liquid, etc. by the heating wire. In the related art, pores in the cotton and the ceramics are irregular, resulting in individual differences in oil lock and oil guide, and poor consistency in mouthfeel of smoke generated by heating and atomization. Moreover, assembly of the cotton or ceramic heating core is difficult. For example, cotton heating cores require manually mounting cotton, and ceramic heating cores have numerous and complex procedures (especially the assembly and welding of heating wires are extremely complex), which lead to problems of a low production efficiency, high reject rates, high individual differences, etc. of the heating cores in the related art, and a failure to satisfy standardized and modular assembly requirements.

In view of this, the present disclosure provides an atomizing core with a high degree of integration. By modularly arranging components of the atomizing core, the degree of integration of the atomizing core can be increased, and the atomizing core can satisfy requirements of standardized and modular assembly, so as to increase production efficiency and product stability. Compared with a cotton heating core (requiring manually mounting cotton) or a ceramic heating core (having problems of numerous and complex procedures) in the related art, each component of the atomizing core in the present disclosure can be produced in a standardized and modular manner, and the components can be assembled automatically, so as to improve product production efficiency and stability.

The atomizing core according to the present disclosure may be used in an electronic cigarette. In the context of the present disclosure, the term "electronic cigarette" refers to a system that produces an aerosol from an atomizing substrate, such as a e-liquid (in particular e-juice, etc.) by means of atomization, etc., for a user to vape, suck, chew or snuff, etc. In some examples, the electronic cigarette may include a storage chamber for storing the atomizing substrate, and an atomizing core for adsorbing and atomizing the atomizing substrate to form an aerosol. An atomizing substrate may be a liquid (for example, e-liquid) or a solid or gel (for example, E-cigarette paste), etc. It is to be understood herein that the atomizing core in the present disclosure may also be used in other apparatuses which need to atomize an atomizing substrate, for example, a medical atomizer, a skin care instrument, an aromatherapy device, etc.

The atomizing core in the present disclosure is described in detail below with reference to FIGS. 1-28.

According to one or more embodiments of the present disclosure, the atomizing core is used for atomizing an atomizing substrate to form an aerosol, and includes: an atomizing core housing defining an airflow inlet, an airflow outlet, an accommodating space between the airflow inlet and the airflow outlet, and at least one atomizing substrate inlet in communication with the accommodating space; an atomizing seat arranged in the accommodating space and defining an atomizing channel for being in communication with the airflow inlet and the airflow outlet, and at least one opening for communicating the at least one atomizing substrate inlet with the atomizing channel; and at least one heating sheet arranged in the atomizing channel and at least partially opposite one or more of the at least one opening respectively.

Figure 2:
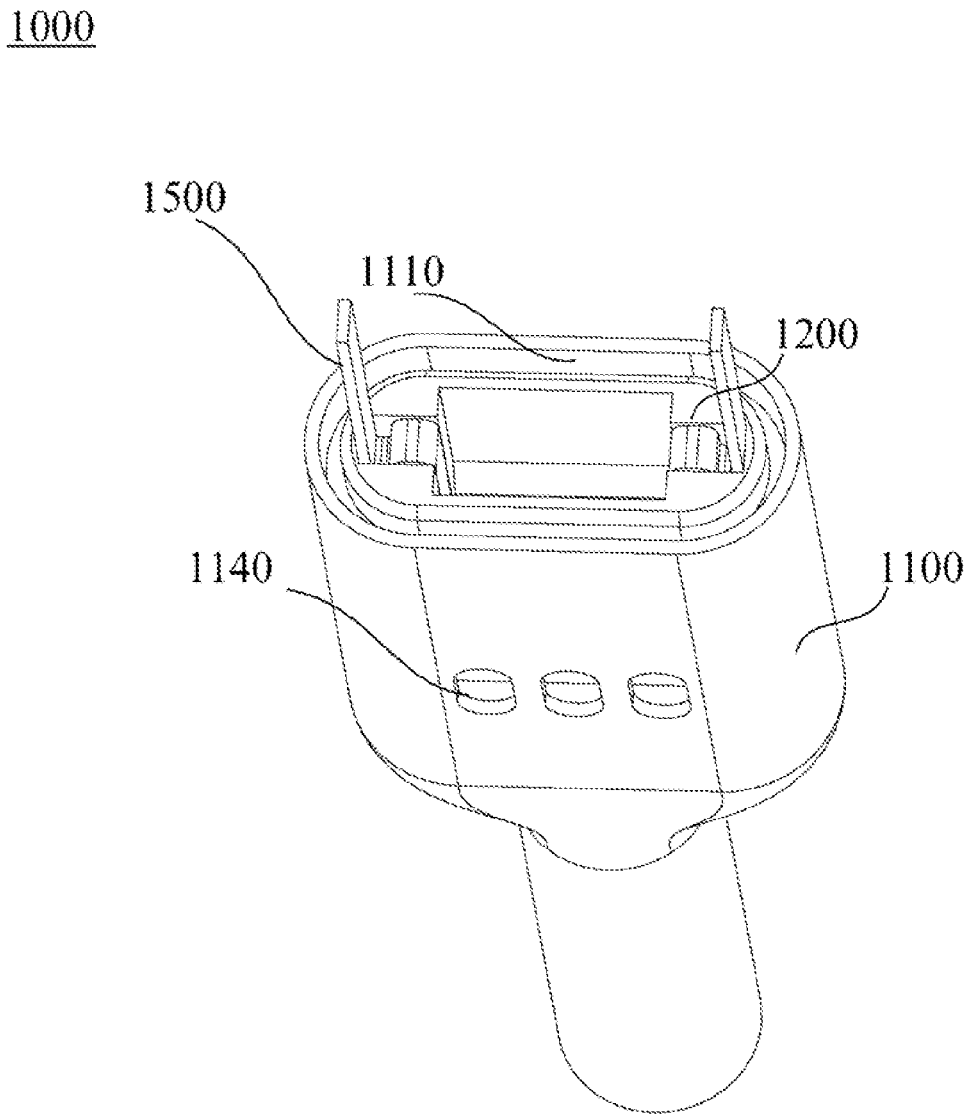
FIG. 2 is a perspective view of the atomizing core in FIG. 1 from another perspective.
Figure 3:
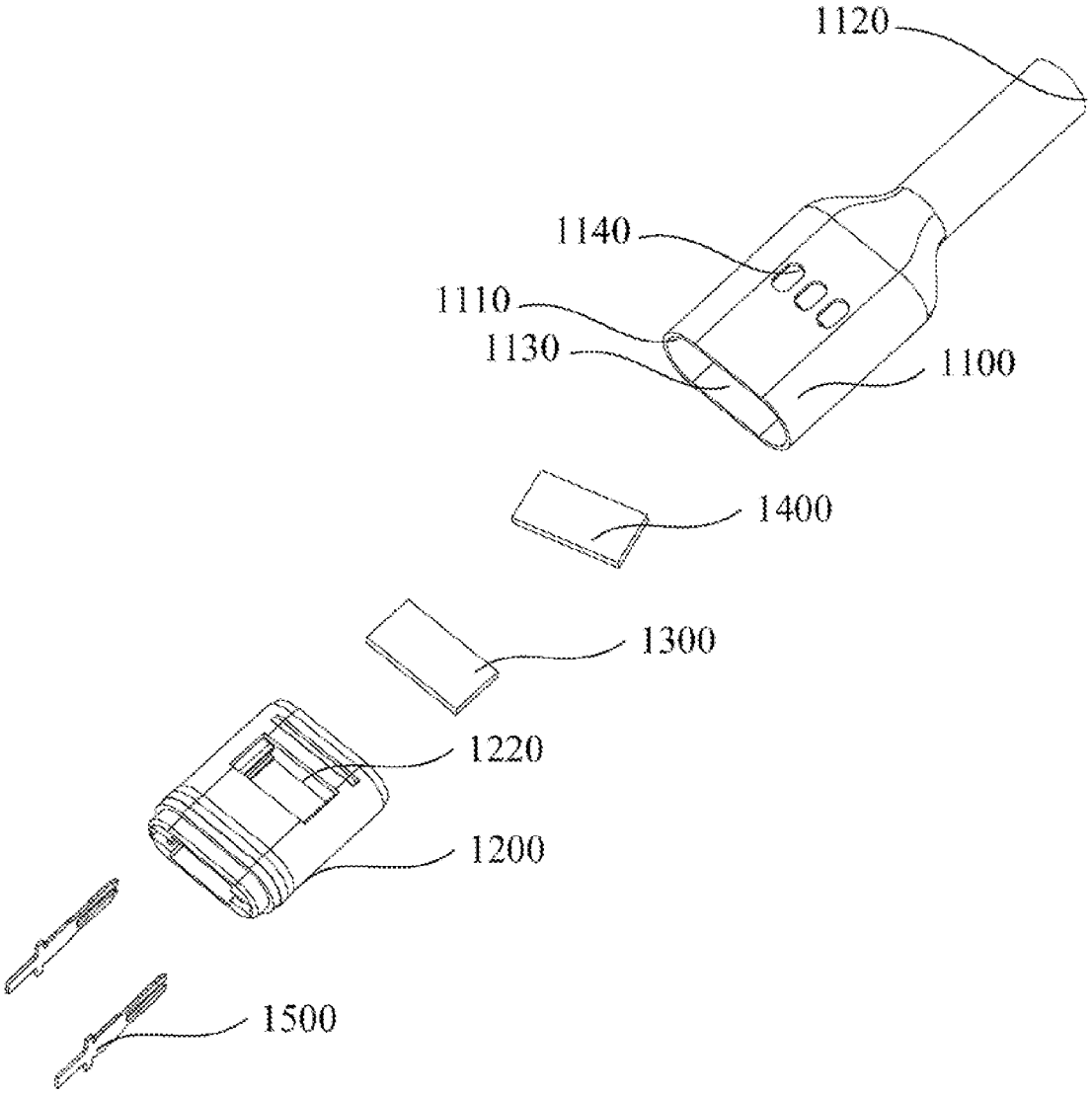
FIG. 3 is an exploded view of the atomizing core in FIG. 1.
Figure 4:
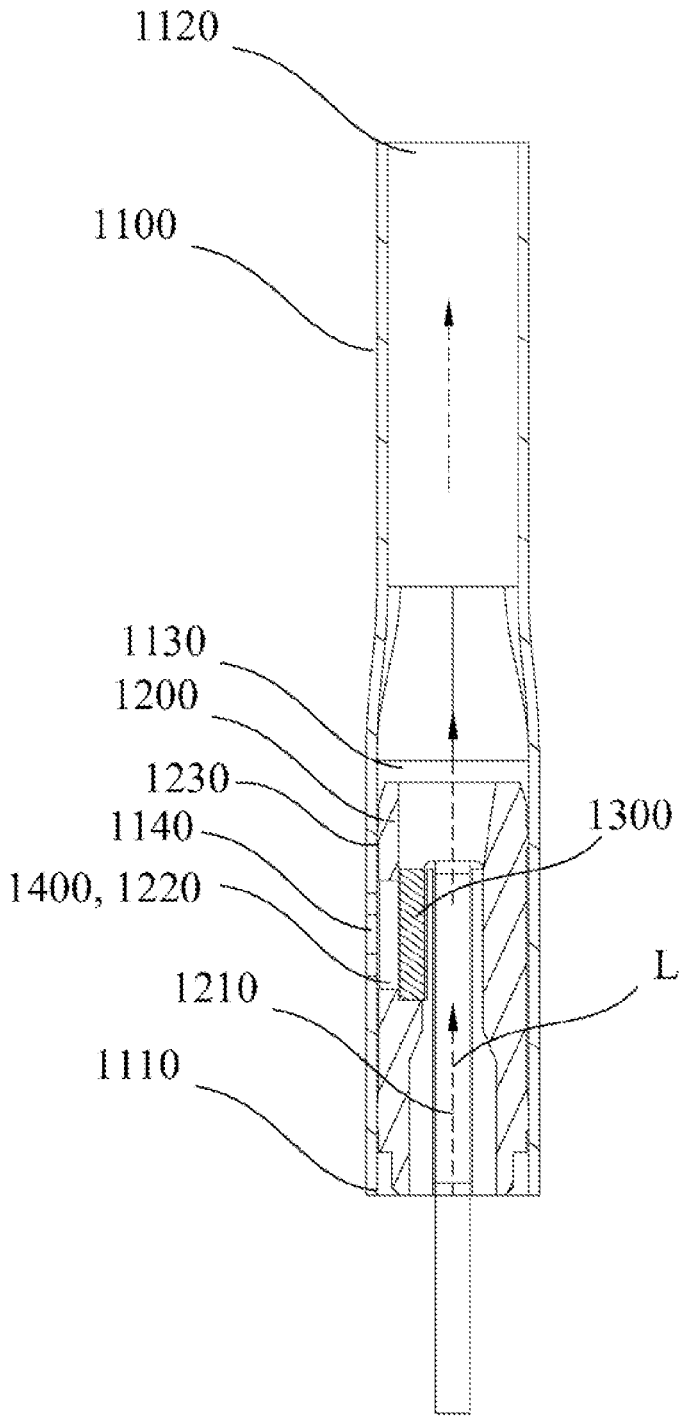
FIGS. 4-6 are sectional views of the atomizing core in FIG. 1 in different sectional planes respectively.
Figure 5:
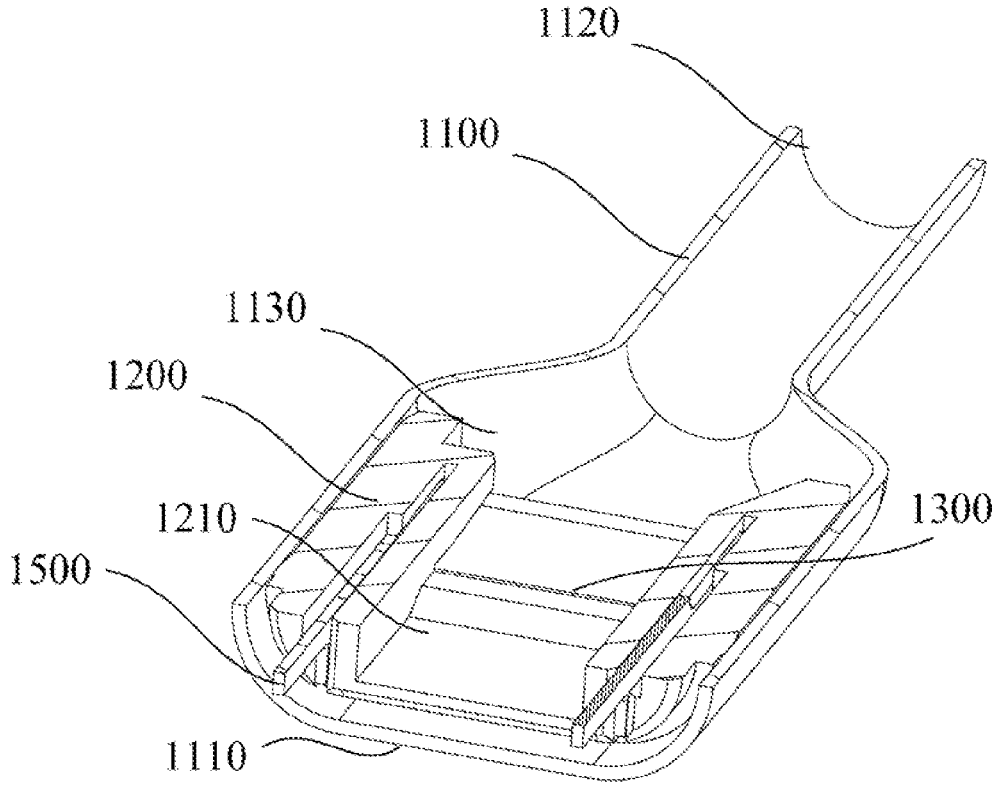
Figure 6:
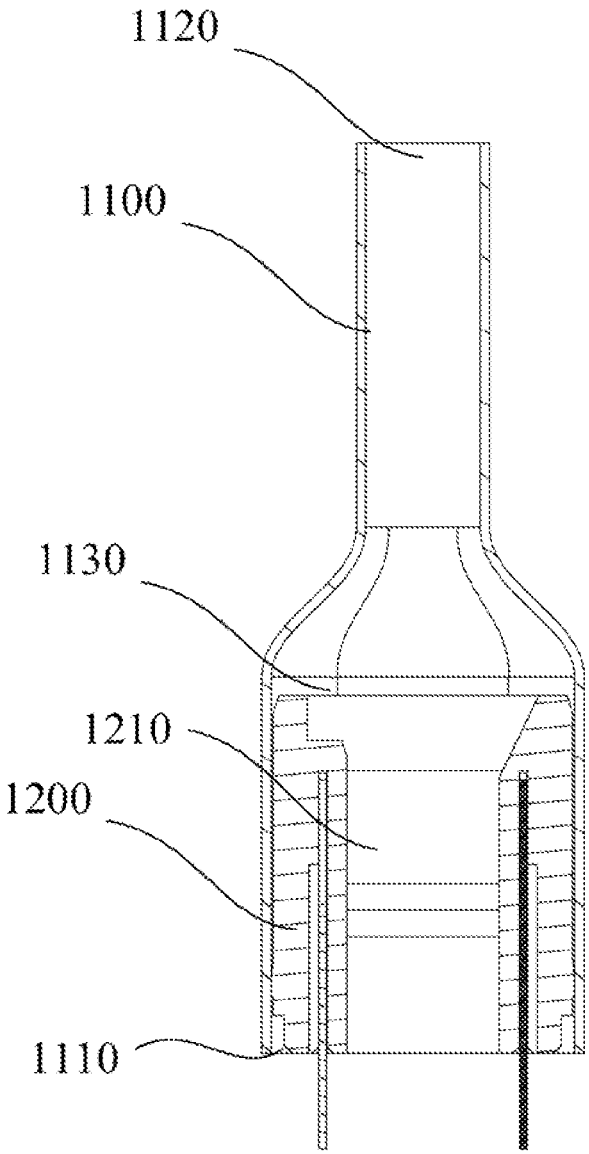
Figure 7:
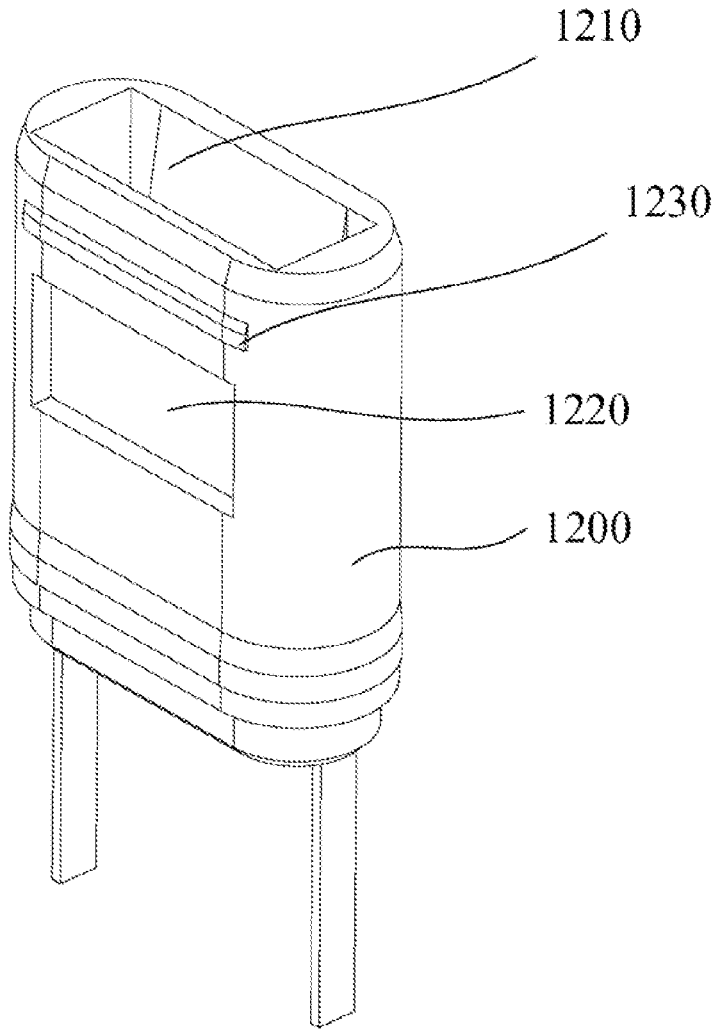
FIG. 7 is a perspective view of an atomizing seat of the atomizing core in FIG. 1.
Figure 8:
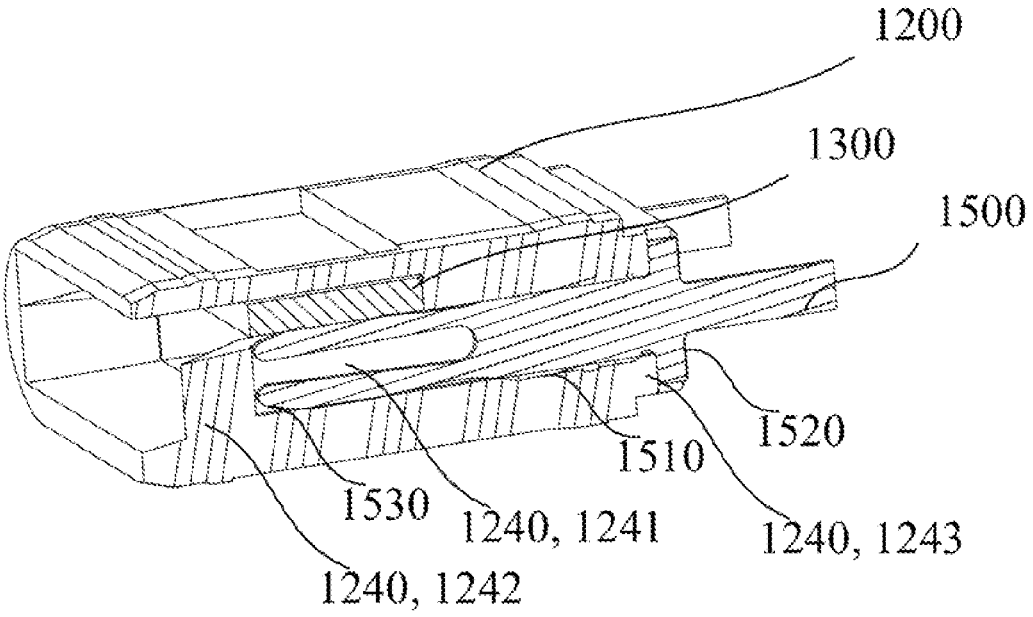
FIG. 8 is a sectional view of the atomizing seat in FIG. 7.

FIGS. 1 and 2 are perspective views of an atomizing core according to some embodiments of the present disclosure from different perspectives. FIG. 3 is an exploded view of the atomizing core in FIG. 1. FIG. 4 is a sectional view of the atomizing core in FIG. 1, with a cutting direction passing through the middle one of three atomizing substrate inlets in FIG. 1. FIGS. 5 and 6 show another sectional view of the atomizing core in FIG. 1, with a cutting direction being orthogonal to the cutting direction of the sectional view in FIG. 4. FIGS. 7 and 8 are a perspective view and a sectional view of an atomizing seat of the atomizing core in FIG. 1 respectively.

As shown in FIGS. 1-4, the atomizing core 1000 includes an atomizing core housing 1100, an atomizing seat 1200, and a heating sheet 1300.

The atomizing core housing 1100 defines an airflow inlet 1110, an airflow outlet 1120, an accommodating space 1130 between the airflow inlet 1110 and the airflow outlet 1120, and a plurality of atomizing substrate inlets 1140 in communication with the accommodating space 1130. As shown in FIG. 1, the atomizing substrate inlets 1140 are formed in and penetrate a wall of the atomizing core housing, so as to communicate a space outside the atomizing core housing with the accommodating space 1130, such that the atomizing substrate located outside the atomizing core housing 1100 may enter into the atomizing core housing 1100. In FIG. 1, three atomizing substrate inlets 1140 are shown. It is to be understood that other numbers of atomizing substrate inlets 1140 may also be provided.

The atomizing seat 1200 is arranged in the accommodating space 1130 and defines an atomizing channel 1210 for being in communication with the airflow inlet 1110 and the airflow outlet 1120, and an opening 1220 for communicating the atomizing substrate inlets 1140 with the atomizing channel 1210. As shown in FIG. 4, a generally central cavity of the atomizing seat 1200 forms the atomizing channel 1210. When the atomizing seat 1200 is mounted in the accommodating space 1130 of the atomizing core housing 1100, one end of the atomizing channel 1210 is in communication with the airflow inlet 1110 of the atomizing core housing 1100, and the other end is in communication with the airflow outlet 1120. Moreover, as shown in FIG. 4, the opening 1220 is formed in and penetrates a side wall of the atomizing seat 1200, and the opening 1220 is opposite the plurality of atomizing substrate inlets 1140 and in communication with the atomizing channel 1210. Thus, the atomizing substrate located outside the atomizing core housing 1100 may enter the atomizing channel 1210 through the plurality of atomizing substrate inlets 1140 and the opening 1220.

The heating sheet 1300 is arranged in the atomizing channel 1210, and the heating sheet 1300 is at least partially opposite the opening 1220, such that the atomizing substrate entering through the atomizing substrate inlets 1140 and the opening 1220 may reach the heating sheet 1300, to be heated by the heating sheet and then to be atomized to form an aerosol.

In the embodiments described above, as shown in FIG. 4, when a user vapes on the airflow outlet 1120, airflow may pass from the airflow inlet 1110 to the airflow outlet 1120 through the atomizing channel 1210 in the atomizing seat 1200, so as to form an airflow pathway. A part of the airflow pathway (that is, the atomizing channel 1210) forms an atomization cavity. One side of the heating sheet 1300 is in communication with the atomizing substrate inlets 1140 through the opening 1220, and the other side thereof is in fluidic communication with air in the atomizing channel 1210. The atomizing substrate located outside the atomizing core housing permeates through the atomizing substrate inlets 1140 and the opening 1220 into the heating sheet 1300, may continue to permeate into the interior of the heating sheet 1300 in an example where the heating sheet 1300 is a heating sheet having micropores, and vaporizes to form a vapor after the atomizing substrate is heated and atomized by means of the heating sheet 1300. The vapor is entrained in the air flowing through the atomizing channel 1210, to form an aerosol for a user to vape.

The implementation described above provides a structurally simple and compact atomizing core 1000, which increases the degree of integration of the atomizing core 1000. The atomizing core housing, the atomizing seat and the heating sheet of the atomizing core 1000 may be designed as standardized or modular components, whereby the atomizing core 1000 may achieve standardized or modular assembly requirements, to increase production efficiency and product stability.

Figure 22:
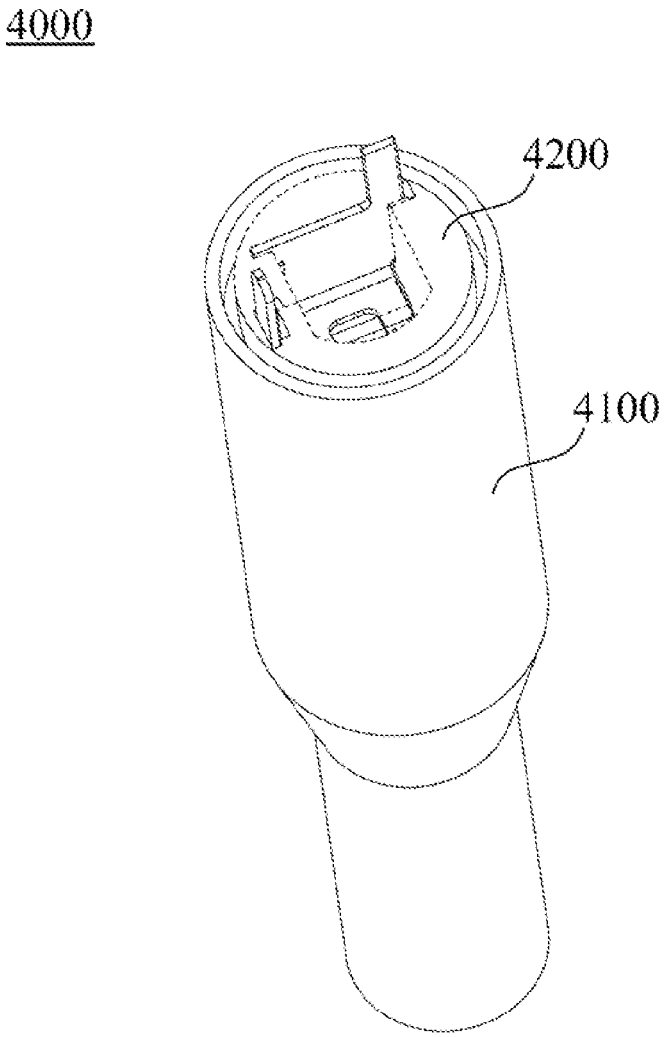
FIG. 22 is a perspective view of an atomizing core according to some other embodiments of the present disclosure.
Figure 23:
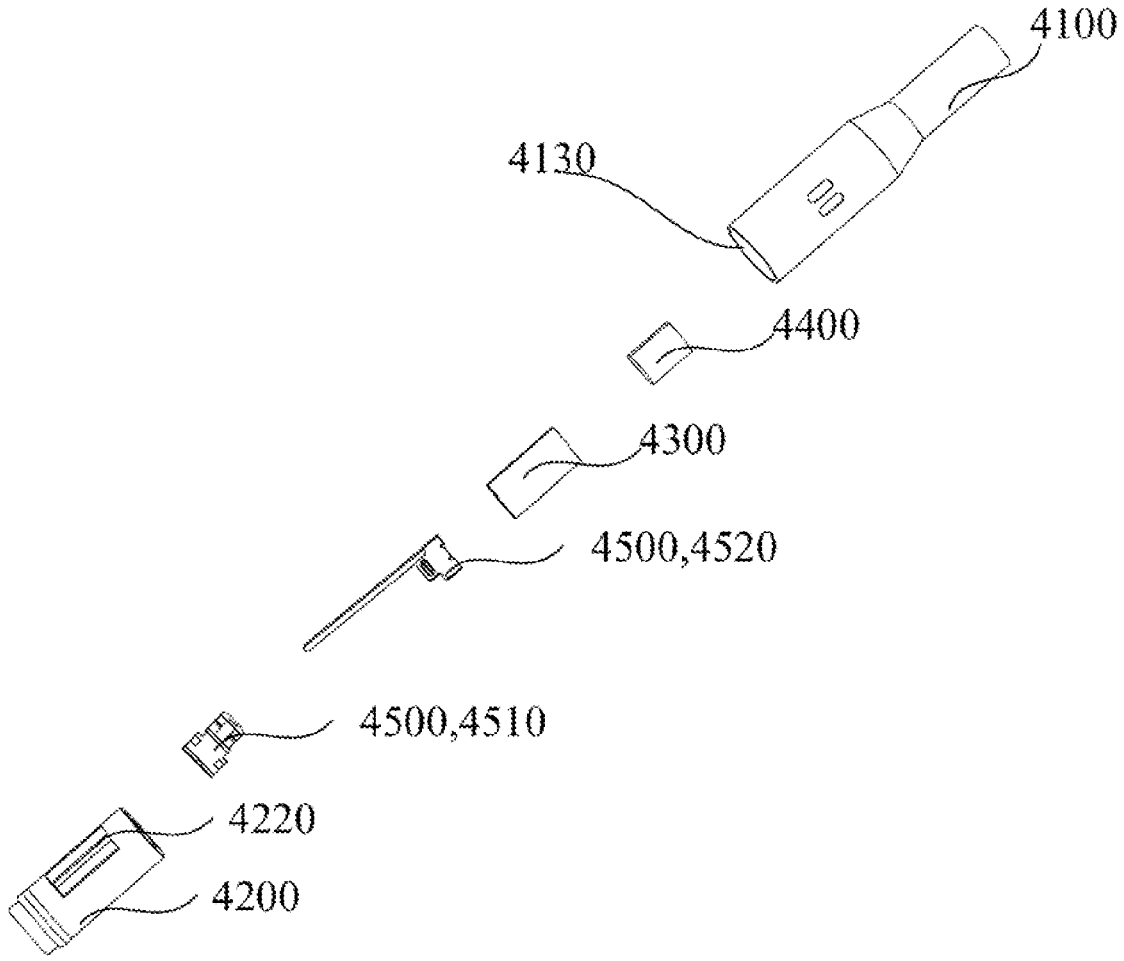
FIG. 23 is an exploded view of the atomizing core in FIG. 22.

The atomizing core housing 1100 is a hollow structure that provides a mounting space for the atomizing seat 1200 and internally forms an airflow pathway where air flows. The atomizing core housing 1100 may be made of a hard material such as metal, for example steel, to facilitate protection of the components therein and separation of the storage chamber from the atomizing channel 1210. The atomizing core housing 1100 may be provided in any shape, for example, a cylindrical shape (as shown in FIGS. 22 and 23), or an elliptical cylindrical shape (as shown in FIGS. 1-3), etc., which is not limited thereto. As shown in FIGS. 1-3, the atomizing core housing 1100 may include an accommodating portion (that is, a portion including the accommodating space 1130) for accommodating the atomizing seat 1200, and a mouthpiece for providing the airflow outlet 1120. The accommodating portion may be provided in a cylindrical or elliptical cylindrical shape, etc. to match the shape of the accommodated atomizing seat 1200. The mouthpiece may be provided in a cylindrical shape having a cross-sectional area smaller than the accommodating portion, to facilitate the vaping of the user.

In some embodiments, the atomizing substrate inlet 1140 arranged in the atomizing core housing 1100 for being in communication with the accommodating space 1130 may be set as one or more windows, or one or more holes, or a combination of both, etc., which is not limited thereto. The number and size of the atomizing substrate inlet may be set as desired, for example, set according to a preset atomizing substrate flow rate, or set to be less than or equal to the size of the heating sheet, etc.

The shape and size of the airflow inlet 1110 arranged in the atomizing core housing 1100 may be set to enable the atomizing seat 1200 to be arranged in the accommodating space 1130 through the airflow inlet 1110. Thus, the atomizing seat 1200 may conveniently enter from the airflow inlet 1110 to be mounted in the accommodating space 1130, and particularly the atomizing seat 1200 may be automatically mounted in the accommodating space 1130 by an automated mounting apparatus. Specifically, for example, the size of the airflow inlet 1110 may be set to be slightly greater than that of a cross-section of the atomizing seat 1200 and/or the shape of the airflow inlet 1110 may be set to match that of the cross-section of the atomizing seat 1200. Similarly, in some examples, the size of the accommodating space 1130 may also be set to be slightly greater than that of the atomizing seat 1200 to facilitate insertion of the atomizing seat 1200 into the accommodating space 1130.

The atomizing seat 1200 is used to provide a mounting space for the heating sheet 1300 and to provide the atomizing channel 1210 where the air, the vapor and the aerosol flow. The atomizing seat 1200 may be entirely embedded in the accommodating space 1130 or partially embedded in the accommodating space 1130. To facilitate mounting, the atomizing seat 1200 may be made of a flexible material such as plastic. The atomizing seat 1200 may be provided in any shape, for example, a cylindrical shape (as shown in FIGS. 22 and 23, for example), or an elliptical cylindrical shape (as shown in FIGS. 1-3, for example), etc., which is not limited thereto.

As shown in FIGS. 4-7, the atomizing channel 1210 in the atomizing seat 1200 may be provided as at least one through hole or through slot having an extension direction L that may coincide with an extension direction of the airflow pathway of the atomizing core housing 1100, so as to communicate the airflow inlet 1110 with the airflow outlet 1120.

As shown in FIG. 7, the opening 1220 in the atomizing seat 1200 may be provided as one or more windows, or one or more holes, or a combination of both, etc., which is not limited thereto. In the embodiment as shown in FIGS. 1-7, the heating sheet 1300 is inserted into the atomizing channel 1210 from one end of the atomizing channel 1210 for being in communication with the airflow outlet 1120, that is, from an upper portion in FIG. 7. With reference to FIG. 4, a step is arranged on an inner wall of the atomizing seat 1200, and the heating sheet 1300 is inserted into the atomizing channel and positioned on the step. Further, with reference to FIG. 5, rails extending in a longitudinal direction of the atomizing seat 1200 may be arranged on two sides of the step, and the heating sheet 1300 may be inserted into the rails and move along the rails to the step. Thus, an automated mounting apparatus may conveniently and automatically mount the heating sheet 1300 in the atomizing channel 1210. In some embodiments, as shown in FIGS. 1-7, the opening 1220 has a size less than the heating sheet, to prevent the heating sheet 1300 from falling out of the opening 1220. In some other embodiments, the shape and size of the opening 1220 may be set to enable the heating sheet 1300 to be mounted in the atomizing channel 1210 through the opening 1220. Specifically, for example, the size of the opening 1220 may be set to be slightly greater than that of the heating sheet 1300, or the size of the opening 1220 may be set to be slightly less than that of the heating sheet 1300 and allow the heating sheet 1300 to pass, for example in a slightly inclined manner, and/or the shape of the opening 1220 may be set to match that of the heating sheet 1300.

As shown in FIGS. 4 and 7, a projection 1230 is arranged on a peripheral side surface of the atomizing seat 1200. When the atomizing seat is mounted in the atomizing core housing 1100, as seen from a longitudinal extension direction of the atomizing core, the projection 1230 is located between the opening 1220 and the airflow outlet 1120 and abuts against an inner wall of the atomizing core housing 1100, to substantially separate a space formed by the inner wall of the atomizing core housing 1100 and a peripheral side wall of the atomizing seat 1200 from the airflow outlet 1120. In the case that the atomizing seat 1200 has a size slightly less than the accommodating space 1130, when the atomizing seat 1200 is inserted into the accommodating space 1130 with a slight gap therebetween, the projection 1230 arranged on the peripheral side surface of the atomizing seat 1200 may abut well against the inner wall of the atomizing core housing 1100, so as to achieve a tighter fit between the atomizing seat 1200 and the atomizing core housing 1100, to prevent leakage of liquid, for example, prevent a liquid entering from the atomizing substrate inlets 1140 from flowing out of the airflow outlet 1120. In some examples, the projection 1230 may be arranged around the entire periphery of the atomizing seat 1200. In some other examples, the projection 1230 may be arranged on only one or two side surfaces of the atomizing seat 1200. For example, as shown in FIG. 7, two projections 1230 are arranged on relatively flat front and rear side surfaces of the atomizing seat 1200 respectively.

Curved surfaces on left and right sides of the atomizing seat 1200 may not be provided with projections 1230 due to manufacturing errors. For an oil-like atomizing substrate, even if the projections 1230 are arranged around only part of the periphery of the atomizing seat 1200, the oil is well prevented from leaking out due to the surface tension present on the oil itself.

Figure 15:
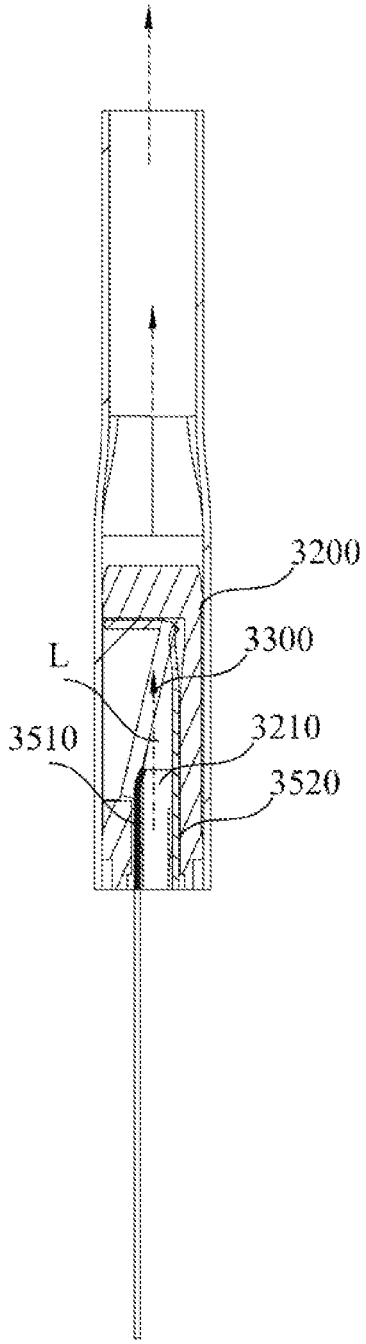
FIG. 15 is a sectional view of the atomizing core in FIG. 12.
Figure 16:
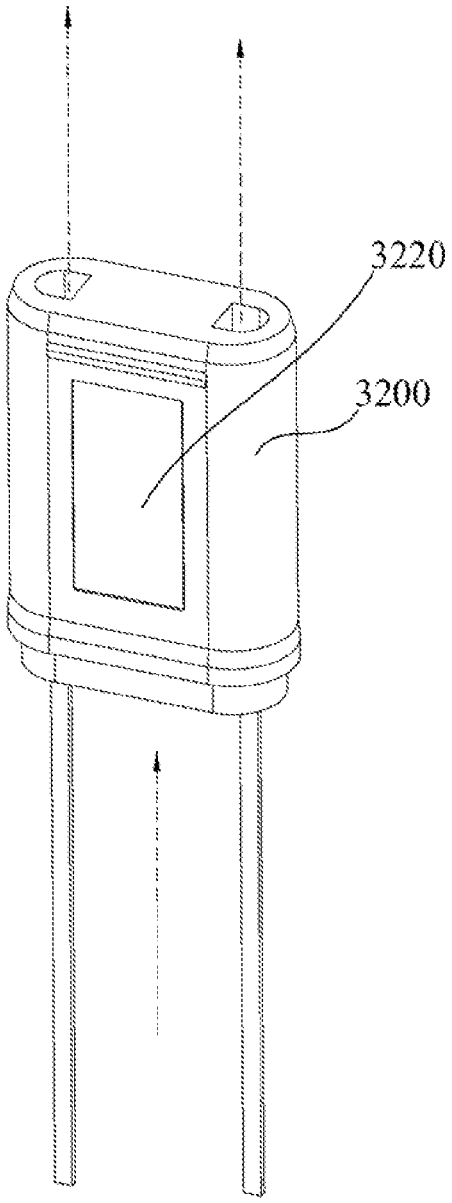
FIG. 16 is a perspective view of an atomizing seat of the atomizing core in FIG. 12.

As shown in FIG. 4, the heating sheet 1300 arranged in the atomizing channel 1210 of the atomizing seat 1200 may be arranged parallel to the extension direction L of the atomizing channel 1210. In this case, air entering the atomizing channel 1210 passes through the heating sheet 1300 in a small area of the heating sheet. Alternatively, the heating sheet may also be arranged at an angle to the extension direction L of the atomizing channel, for example, at an angle of about 15 degrees (as shown in FIG. 15), so as to increase the area of the heating sheet 1300 through which the air entering the atomizing channel 1210 passes. By changing the angle between the heating sheet and the extension direction of the atomizing channel, the area of the heating sheet 1300 through which the air entering the atomizing channel passes may be changed, thereby changing distribution characteristics of the formed aerosol. When e-liquid is used as the atomizing substrate, the mouthfeel of the aerosol may be changed.

A surface of the heating sheet 1300 is provided with an electrode contact. The electrode contact may be arranged on a second surface of the heating sheet 1300 facing away from the opening 1220, to avoid contact between the electrode contact and the e-liquid, etc., and an electrode 1500 may be conveniently inserted from the atomizing channel 1210 into the atomizing seat 1200 and in contact with the electrode contact. Thus, the ease of assembly of the atomizing core 1000 may be further improved.

The heating sheet 1300 may be of a sheet structure having a plurality of micropores, and the plurality of micropores are used for adsorbing the atomizing substrate by means of a capillary action. In this way, not only the amount of adsorbed atomizing substrate such as e-liquid may be controlled or enhanced, but also oil intake is more uniform, such that the formed aerosol has a more gentle and more consistent mouthfeel. Furthermore, when the atomizing substrate supplied to the heating sheet 1300 is exhausted, dry burning of the heating sheet may be avoided by means of an atomizing substrate stored in the micropores of the heating sheet 1300, so as to avoid generating a burning taste. In some examples, the plurality of micropores on the heating sheet 1300 may be formed by laser or chemical etching, to guarantee uniformity of the plurality of formed micropores, so as to further increase the amount of absorbed atomizing substrate such as e-liquid. In some examples, the pore size of the plurality of micropores may be set to be on the order of micrometers. Thus, the atomizing substrate may be prevented from passing through the heating sheet 1300 into the atomizing channel using the tension of the atomizing substrate such as e-liquid, so as to reduce the risk of leakage. In some examples, a metal plating for heating the atomizing substrate is arranged on one side of the sheet structure of the heating sheet 1300. In some examples, the heating sheet 1300 may be made of glass, ceramic, or mica, etc.

As shown in FIG. 4, a first surface of the heating sheet 1300 facing the opening 1220 rests against the inner wall of the atomizing seat 1200, and a glue is provided for sealing between the first surface and, for example, the inner wall of the atomizing seat 1200. Thus, the e-liquid entering the atomizing substrate inlet 1140 and the opening 1220 may be prevented from bypassing the heating sheet 1300 into the atomizing channel 1210, so as to reduce the risk of leakage. Alternatively, the heating sheet 1300 may not rest against the inner wall of the atomizing seat 1200, and a seal is provided for sealing between the two.

To further reduce the risk of leakage, the atomizing core 1000 may further include an absorbing material 1400 for the atomizing substrate. For the e-liquid, oil guide cotton may be used as the absorbing material for the atomizing substrate. The absorbing material 1400 for the atomizing substrate is embedded in the opening 1220 and is located between the atomizing substrate inlet 1140 and the heating sheet 1300. A first side surface of the absorbing material 1400 for the atomizing substrate covers the atomizing substrate inlet 1140 opposite the absorbing material for the atomizing substrate from an inner side of the atomizing core housing, and a second side surface of the absorbing material for the atomizing substrate opposite the first side surface rest against the heating sheet opposite the absorbing material for the atomizing substrate, in particular to the first surface of the heating sheet 1300 facing the opening 1220. Thus, a buffer structure may be arranged between the heating sheet 1300 and the atomizing substrate, to avoid direct contact between the heating sheet 1300 and the atomizing substrate, and further to avoid the situation that the atomizing substrate (for example, e-liquid) impacts on the heating sheet with a too high flow rate, and then directly enters the atomizing channel 1210 without atomization. In some examples, the absorbing material 1400 for the atomizing substrate may include cotton. Cotton is composed of fibers, and can achieve oil absorption and oil guide, thus facilitating buffering, and avoiding the effect of oil overload. Moreover, cotton has a feature of even distribution of pores, making the oil guide smoother. In some examples, a shape of the absorbing material 1400 for the atomizing substrate may be adaptively set according to an angle at which the heating sheet 1300 is placed. For example, as shown in FIG. 3, when the heating sheet 1300 is parallel to the extension direction L of the atomizing channel 1210, a longitudinal section of the absorbing material 1400 for the atomizing substrate may be set as a rectangle. In some other examples (which will be described in detail below in connection with FIGS. 14 and 15), when the heating sheet is angled with respect to the extension direction of the atomizing channel, the longitudinal section of the absorbing material 1400 for the atomizing substrate may be set as a trapezoid, etc., such that one side of the absorbing material for the atomizing substrate may cover the atomizing substrate inlet 1140, and the other side rests against the first surface of the heating sheet 1300 opposite the opening 1220.

The atomizing core 1000 may further include electrodes 1500 (in the embodiment as shown in FIG. 1, two electrodes) for contacting electrode contacts on the heating sheet. The electrodes 1500 may be inserted into the atomizing seat 1200 through the atomizing channel 1210, to contact the electrode contacts on the heating sheet 1300. The shape and size of the electrodes 1500 may be set according to the orientation of placement of the heating sheet 1300 and/or the shape of the atomizing seat 1200. In the embodiments as shown in FIGS. 1-8, one of the electrodes 1500 may be set to have a Y-shaped structure on its upper portion, such that a side surface of the electrode may contact the heating sheet 1300 after the electrode is inserted into the atomizing channel 1210. Furthermore, when two heating sheets are oppositely arranged, the electrode having the Y-shaped structure on the upper portion may contact the electrode contacts on the two heating sheets simultaneously by means of two branches of the Y-shaped structure.

To ensure that the electrodes 1500 contact the electrode contact during assembly, the atomizing seat 1200 may also define a limiting structure. For example, as shown in FIG. 8, the atomizing seat 1200 defines a limiting structure 1240 on a side of the heating sheet 1300 facing away from the opening 1220. The limiting structure 1240 includes a limiting channel 1241. The electrodes 1500 are inserted into the limiting channel 1241 of the limiting structure 1240 for contacting the electrode contact. The shape and size of the limiting channel 1241 may be adapted to the electrodes 1500 to ensure stability of the position of the electrode 1500 inserted into the atomizing seat 1200 relative to the atomizing seat 1200, such that contact between the electrodes 1500 and the electrode contacts is ensured even in an automated assembly process.

As shown in FIG. 8, one electrode of the electrodes 1500 defines a first protrusion 1510 for abutting against an inner wall of the limiting channel 1241. The first protrusion 1510 may be a projection of approximately 15° on the electrode 1500 for tightly matching the inner wall of the limiting channel 1241 after insertion into the limiting channel 1241. It is to be understood that the first protrusion may also be set as a projection of another angle as desired. In some examples, as shown in FIG. 8, the electrode 1500 may further define, in sequence, a first end 1530 and a second protrusion 1520 (for example, forming an electrode having a cross-shaped structure at a lower portion) in the extension direction L of the atomizing channel 1210. The second protrusion 1520 is used for abutting against a limiting portion of the limiting structure 1240 to limit the position of the electrode 1500 in the extension direction L of the atomizing channel 1210.

As shown in FIGS. 4 and 8, the limiting channel 1241 extends inwardly from a first end surface of the atomizing seat 1200 proximate to the airflow inlet 1110. Specifically, the limiting channels 1241 corresponding to the two electrodes 1500 both extend inwardly from the first end surface of the atomizing seat 1200 proximate to the airflow inlet 1110. Thus, assembly directions of the two electrodes 1500 may be the same, to improve the convenience of assembly of the electrodes 1500.

As shown in FIG. 8, the limiting structure 1240 may further include a first limiting portion 1242 and a second limiting portion 1243. The first limiting portion 1242 is arranged proximate to the heating sheet 1300, and the second limiting portion 1243 is formed by the first end surface of the atomizing seat 1200. In this case, the first end 1530 of the electrode abuts against the first limiting portion 1242, and the second protrusion 1520 abuts against the second limiting portion 1243. Thus, the position of the electrode in the extension direction L of the atomizing channel 1210 may be further limited, such that contact between the electrode and the electrode contact is ensured even in an automated assembly process.

In some embodiments, a glue is provided for enclosing among respective ends of the electrodes 1500 and the atomizing seat 1200 proximate to the airflow inlet 1110, and the atomizing core housing 1100, such that e-liquid, etc. may be prevented from leaking from the bottom of the atomizing core 1000 and thus affecting a battery.

Figure 9:
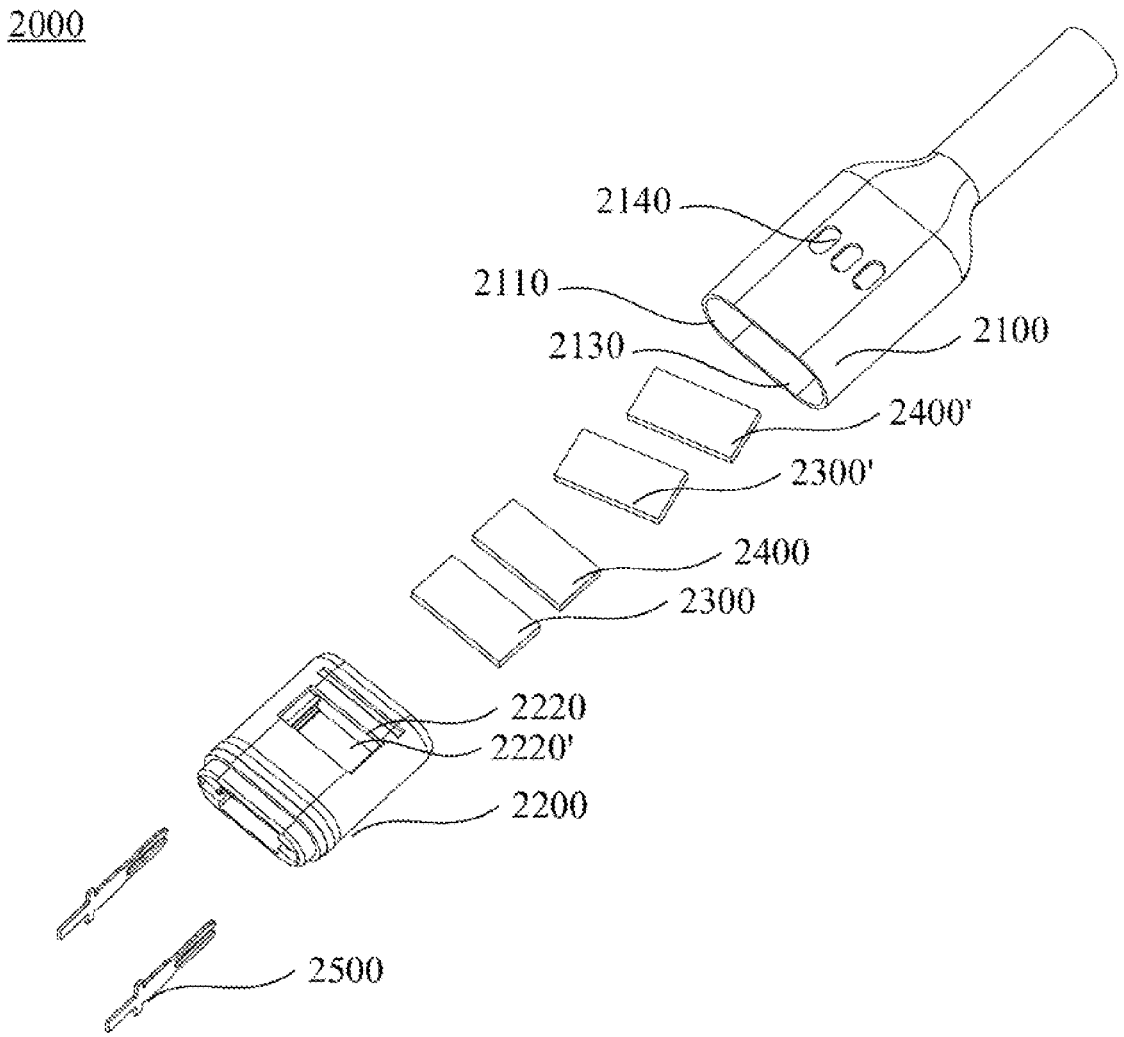
FIG. 9 is an exploded view of an atomizing core according to some other embodiments of the present disclosure.
Figure 10:
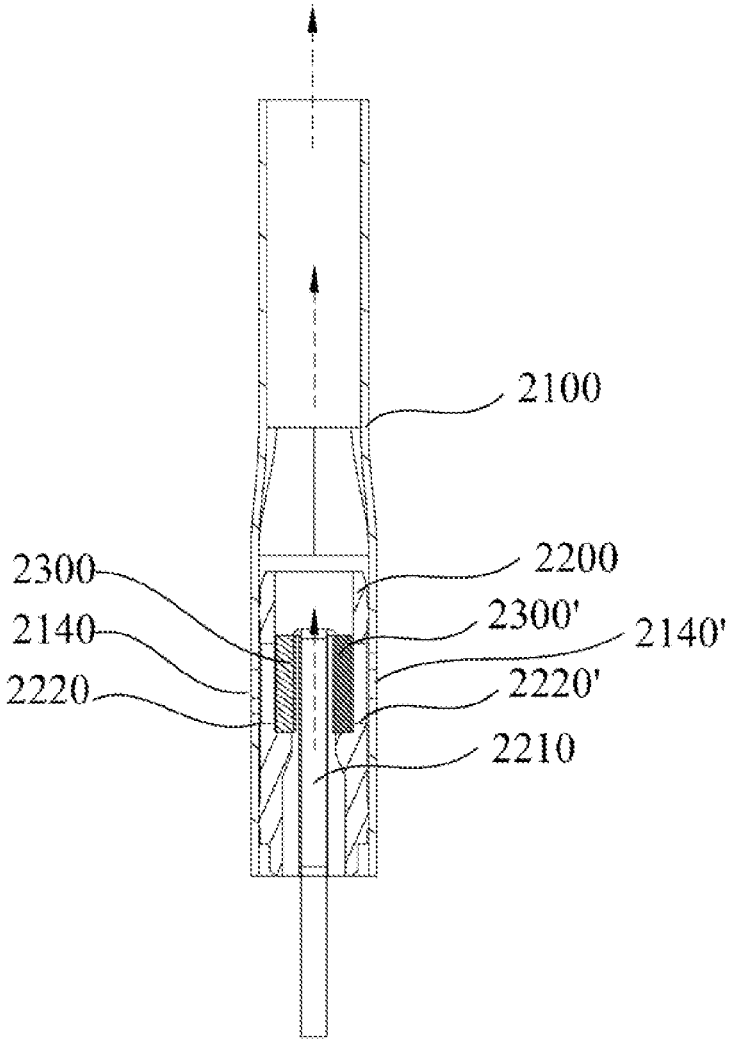
FIG. 10 is a sectional view of the atomizing core in FIG. 9.
Figure 11:
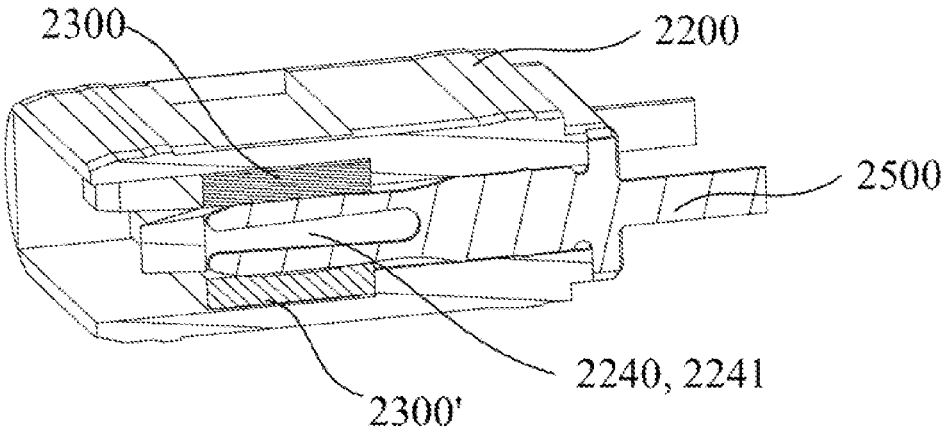
FIG. 11 is a sectional view of an atomizing seat of the atomizing core in FIG. 9.
Figure 12:
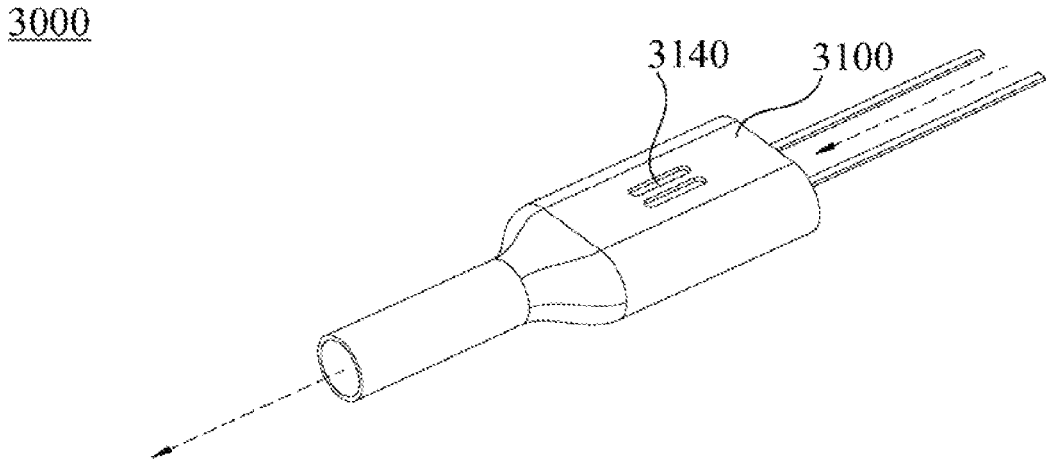
FIG. 12 is a perspective view of an atomizing core according to some other embodiments of the present disclosure.
Figure 13:
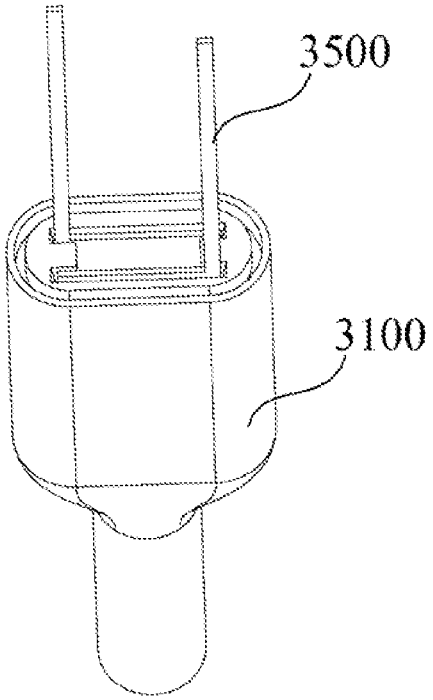
FIG. 13 is a perspective view of the atomizing core in FIG. 12 from another perspective.

FIGS. 9-11 show an atomizing core 2000 according to some other embodiments of the present disclosure. Features of the atomizing core 2000 in FIGS. 9-11 are substantially the same as those of the atomizing core 1000 in FIGS. 1-8, with a difference being that the atomizing core 2000 in FIGS. 9-11 is provided with two heating sheets. Correspondingly, an atomizing core housing 2100 is provided with atomizing substrate inlets at two positions corresponding to the heating sheets, and an atomizing seat 2200 is provided with two openings.

Specifically, the atomizing core 2000 includes a first heating sheet 2300 having the features of the heating sheet 1300 as shown in FIGS. 1-8, a first atomizing substrate inlet 2140 having the features of the atomizing substrate inlet 1140 as shown in FIGS. 1-8, and a first opening 2220 having the features of the opening 1220 as shown in FIGS. 1-8. Besides, the atomizing core housing further defines a second atomizing substrate inlet 2140' for being in communication with an accommodating space and opposite the first atomizing substrate inlet 2140. Accordingly, the atomizing seat further defines a second opening 2220' for communicating the second atomizing substrate inlet 2140' with an atomizing channel 2210 and opposite the first opening 2220. The atomizing core further includes a second heating sheet 2300', the second heating sheet 2300' being arranged in the atomizing channel 2210 and at least partially opposite the second opening 2220'.

As shown in FIGS. 9-11, the first atomizing substrate inlet 2140 and the second atomizing substrate inlet 2140' are formed in two opposing side walls of the atomizing core housing, respectively. The first opening 2220 and the second opening 2220' are formed in two opposing side walls of the atomizing seat, respectively. The first heating sheet 2300 is at least partially opposite the first opening 2220, and the second heating sheet 2300' is at least partially opposite the second opening 2220', such that the atomizing substrate may reach the first heating sheet 2300 through the first atomizing substrate inlet 2140 and the first opening 2220 and/or reach the second heating sheet 2300' through the second atomizing substrate inlet 2140' and the second opening 2220'.

Features of the second heating sheet 2300', the second opening 2220' and the second atomizing substrate inlet 2140' are the same as those of the heating sheet 1300, the opening 1220 and the atomizing substrate inlet 1140, respectively, as shown in FIGS. 1-8. It is to be noted herein that the features of the first heating sheet 2300 and the second heating sheet 2300' may be set to be the same or not, for example, to different sizes, etc. Similarly, the features of the first opening 2220 and the second opening 2220' may be set to be the same or not, and the features of the first atomizing substrate inlet 2140 and the second atomizing substrate inlet 2140' may be set to be the same or not.

Accordingly, a second absorbing material 2400' for the atomizing substrate may further be set for the second heating sheet 2300'. Features of the second absorbing material 2400' for the atomizing substrate are the same as those of the absorbing material 1400 for the atomizing substrate as shown in FIGS. 1-8.

In the embodiments described above, the atomizing core 2000 may further include electrodes 2500 having the same features as the electrodes 1500 as shown in FIGS. 1-8. One of the electrodes 2500 may be of a Y-shaped structure, so as to simultaneously make contact with electrode contacts on two opposing heating sheets after insertion into the limiting structure 2240.

It is to be understood herein that besides the features described above, other features of the atomizing core 2000 (for example, features of the limiting structure 2240, other features of the electrodes 2500, etc.) may be the same as the corresponding features of the atomizing core 1000 described in FIGS. 1-8 and will not be described in detail herein for the sake of brevity.

FIGS. 12-21 show an atomizing core 3000 according to some other embodiments of the present disclosure. Features of the atomizing core 3000 in FIGS. 12-21 are substantially the same as those of the atomizing core 1000 in FIGS. 1-8, with a difference being that the heating sheet 3300 in the atomizing core 3000 in FIGS. 12-21 is arranged at an angle (that is, arranged obliquely) to the extension direction L of the atomizing channel 3210, so as to increase the area of the heating sheet 3300 through which the air entering the atomizing channel 3210 passes, as shown in FIG. 15. By setting the angle between the heating sheet 3300 and the extension direction L of the atomizing channel 3210, the area of the heating sheet 3300 through which the air entering the atomizing channel 3210 passes may be changed, thereby changing distribution characteristics of the formed aerosol. When e-liquid is used as the atomizing substrate, the mouthfeel of the aerosol may be changed.

The atomizing core 3000 may further include an absorbing material 3400 for the atomizing substrate. A longitudinal section of the absorbing material 3400 for the atomizing substrate may be set as a trapezoid, such that a first side of the absorbing material for the atomizing substrate may cover the atomizing substrate inlet 3140 from an inner side of the atomizing core housing, and a second side of the absorbing material for the atomizing substrate opposite the first side may rest against the first surface of the heating sheet 3300 opposite the opening 3220.

Figure 14:
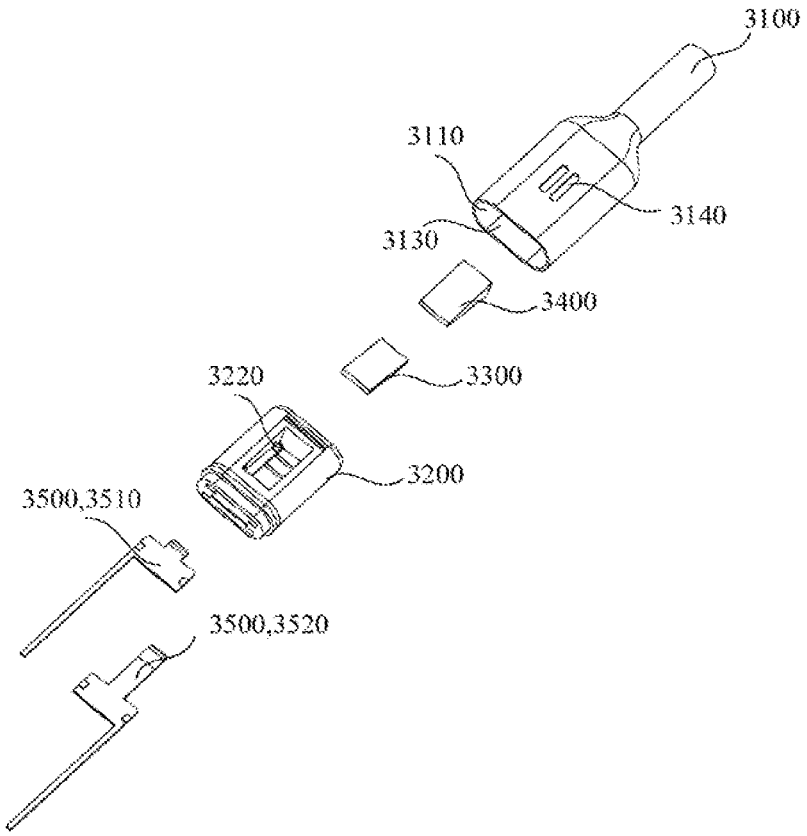
FIG. 14 is an exploded view of the atomizing core in FIG. 12.
Figure 20:
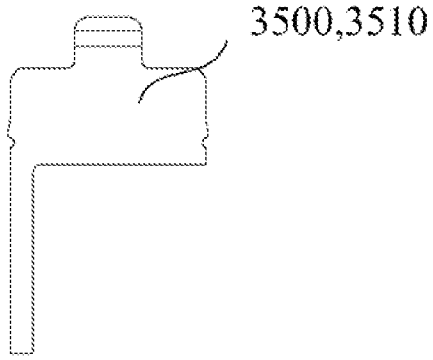
FIGS. 20 and 21 are schematic diagrams of two electrodes in the atomizing core in FIG. 12 respectively.
Figure 21:
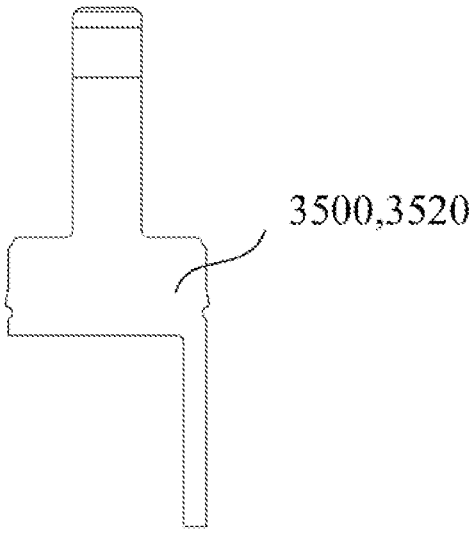

The atomizing core 3000 may further include electrodes 3500, specifically, a first electrode 3510 and a second electrode 3520. The electrodes may be inserted into the atomizing seat 3200 through the atomizing channel 3210, to contact the electrode contacts on the heating sheet 3300. The shape and size of the electrodes may be set according to the orientation of placement of the heating sheet 3300 and/or the shape of the atomizing seat 3200. In embodiments where the heating sheet 3300 is arranged obliquely, the structures of the two electrodes of the atomizing core 3000 may be different. Specifically, lengths of the two electrodes in the extension direction L of the atomizing channel 3210 are different (as shown in FIGS. 14, 20 and 21), such that the two electrodes may respectively contact the electrode contacts located at different depths of the heating sheet 3300 after insertion into the atomizing channel 3210. Specifically, a length of an upper portion of the first electrode 3510 is shorter than that of the second electrode 3520. In this case, the first electrode and the second electrode are arranged in an upper and lower staggered manner within the atomizing seat. Accordingly, the two electrodes may be of an "L" shape.

Figure 17:
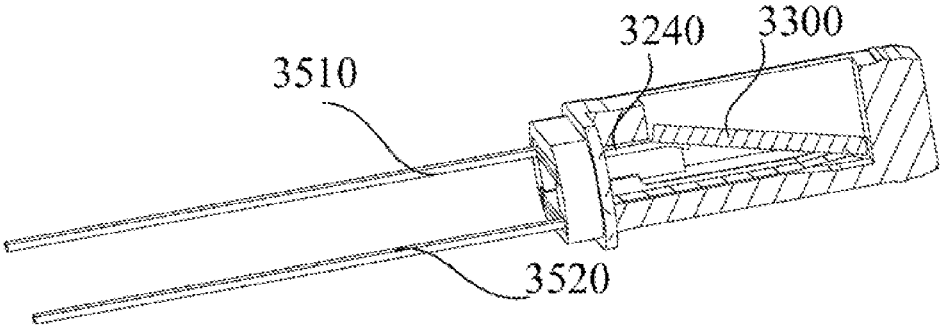
FIGS. 17-19 are sectional views of the atomizing seat in FIG. 16 in different sectional planes respectively.
Figure 18:
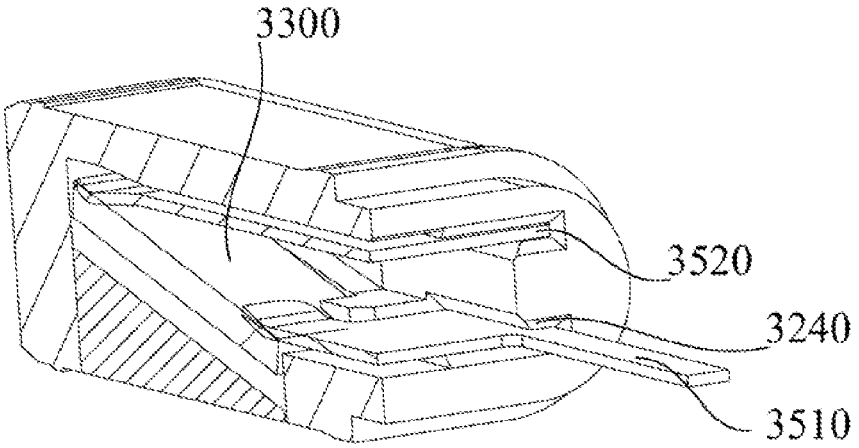
Figure 19:
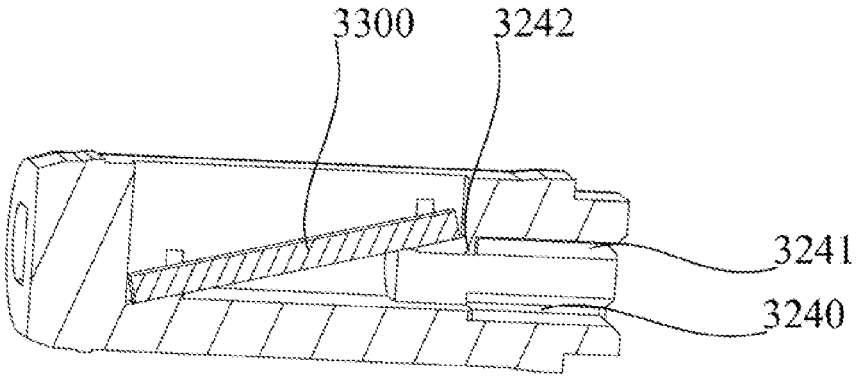

To ensure that the electrodes make contact with the electrode contacts during assembly, as shown in FIGS. 17-19, the atomizing seat 3200 may further define a limiting structure 3240 on a side of the heating sheet 3300 facing away from the opening 3220. The limiting structure 3240 may include at least one limiting channel 3241 and at least one ramp 3242. A second surface of the heating sheet 3300 facing away from the opening or facing away from the inner wall of the atomizing core housing rest against the at least one ramp 3242. In this case, during assembly, after the heating sheet 3300 is mounted into the atomizing channel 3210 for example through the opening 3220, the heating sheet 3300 may abut against the ramp 3242, thereby achieving the positioning of the heating sheet 3300. An angle of inclination of the ramp 3242 determines the angle of inclination of the heating sheet. After the heating sheet 3300 is assembled, the first electrode and the second electrode may be inserted through the respective limiting channels 3241, to contact the electrode contacts on the heating sheet 3300.

The atomizing seat 3200 may define two ramps 3242 corresponding to the two electrodes, the two ramps 3242 are located at ends of the two limiting channels 3240 respectively, and the second surface of the heating sheet 3300 rests against the two ramps 3242. The implementation described above may prevent the ramps 3242 from blocking the air in the atomizing channel 3210 to pass through the heating sheet 3300, such that inhalation of the aerosol is smoother.

It is to be understood herein that besides the features described above, other features of the atomizing core 3000 (for example, features of the atomizing seat, other features of the electrode, etc.) may be the same as the corresponding features of the atomizing core 1000 described in FIGS. 1-8 and will not be described in detail herein for the sake of brevity.

FIGS. 22-28 show an atomizing core 4000 according to some other embodiments of the present disclosure. Features of the atomizing core 4000 in FIGS. 22-28 are substantially the same as those of the atomizing core 1000 in FIGS. 1-8, with a difference being that an atomizing seat 4200 and an atomizing core housing 4100 in the atomizing core 4000 in FIGS. 22-28 are of a cylindrical shape.

Figure 24:
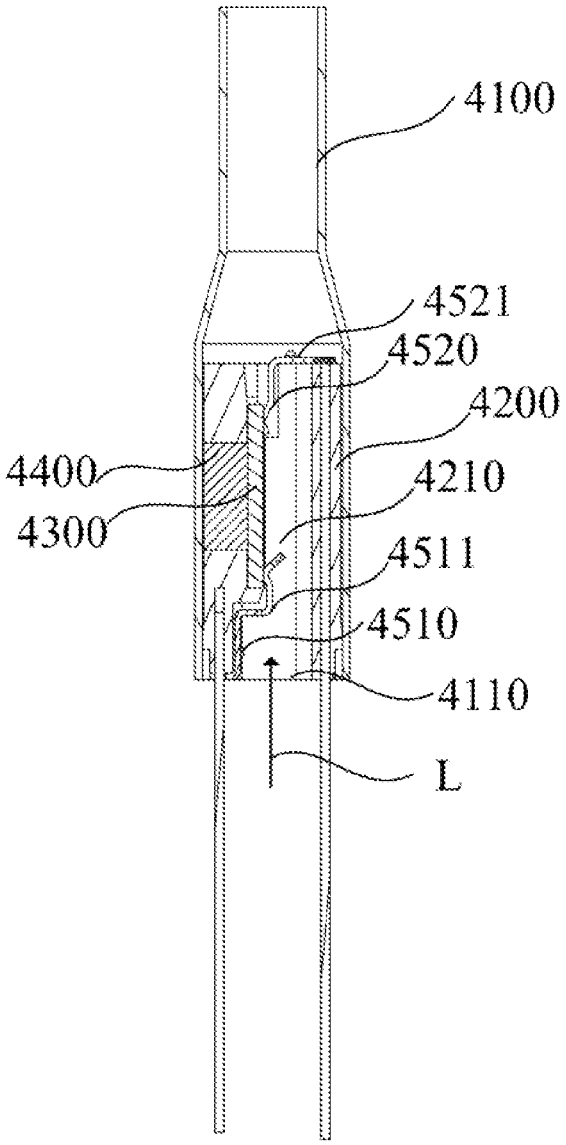
FIGS. 24 and 25 are sectional views of the atomizing core in FIG. 22 from different perspectives respectively.
Figure 25:
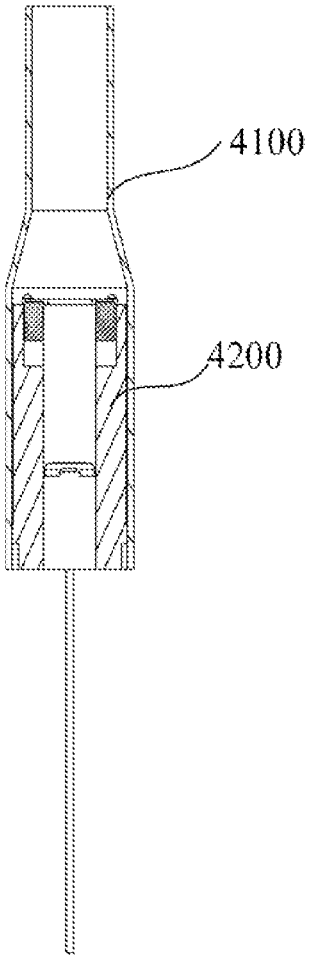
Figure 27:
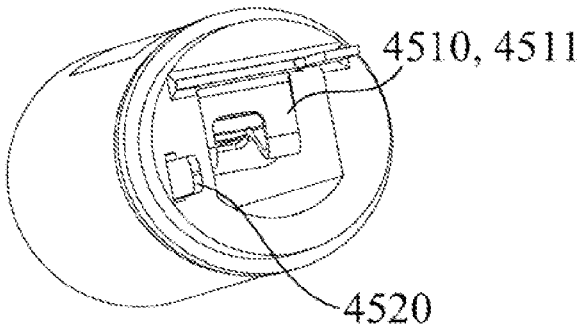
FIG. 27 is a perspective view of an atomizing seat of the atomizing core in FIG. 22 from another perspective.
Figure 28:
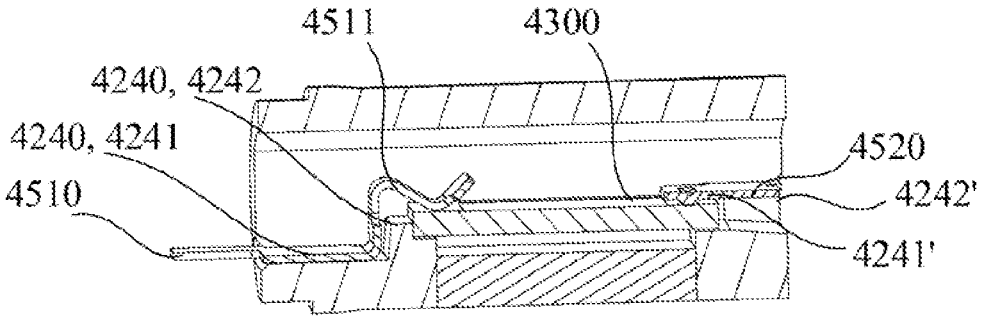
FIG. 28 is a sectional view of the atomizing seat in FIG. 26.

The atomizing core 4000 may further include electrodes 4500, specifically, a first electrode 4510 and a second electrode 4520. Each electrode 4500 may be inserted into the atomizing seat 4200 through the atomizing channel 4210, to contact the electrode contacts on the heating sheet 4300. The shape and size of the electrodes 4500 may be set according to the orientation of placement of the heating sheet 4300 and/or the shape of the atomizing seat 4200. In this embodiment, as shown in FIGS. 24, 27 and 28, an intermediate position of the first electrode 4510 defines a first bent portion 4511, and an end position of the second electrode 4520 defines a second bent portion 4521. In this case, the first electrode 4510 and the second electrode 4520 may be of a horseshoe shape as shown in FIGS. 23 and 24.

To ensure contact between the electrodes 4500 and the electrode contacts during assembly, as shown in FIG. 8, the limiting structure 4240 of the atomizing seat 4200 includes two limiting channels, a first limiting channel 4241 of the two limiting channels extends inwardly from a first end surface of the atomizing seat 4200 proximate to the airflow inlet 4110, and a second limiting channel 4241' of the two limiting channels extends inwardly from a second end surface of the atomizing seat 4200 opposite the first end surface. The two limiting channels extending inwardly from different directions may save space on the atomizing seat 4200, making the atomizing core 4000 more compact.

The first limiting channel 4241 further includes a third limiting portion 4242. The third limiting portion 4242 is of a stepped structure and proximate to the heating sheet 4300. The first bent portion 4511 abuts against the third limiting portion 4242. The second limiting channel 4241' further includes a fourth limiting portion 4242'. The fourth limiting portion 4242' is formed by the second end surface of the atomizing seat 4200. The second bent portion 4521 abuts against the fourth limiting portion 4242'. Thus, the positions of the first electrode and the second electrode in the extension direction L of the atomizing channel 4210 may be limited, such that the first electrode and the second electrode may make contact with the electrode contacts on the heating sheet 4300 after inserting into the limiting structure.

It is to be understood herein that besides the features described above, other features of the atomizing core 4000 (for example, features of the atomizing core housing 4100, other features of the electrode 4500, etc.) may be the same as the corresponding features of the atomizing core 1000 described in FIGS. 1-8 and will not be described in detail herein for the sake of brevity.

Figure 29:
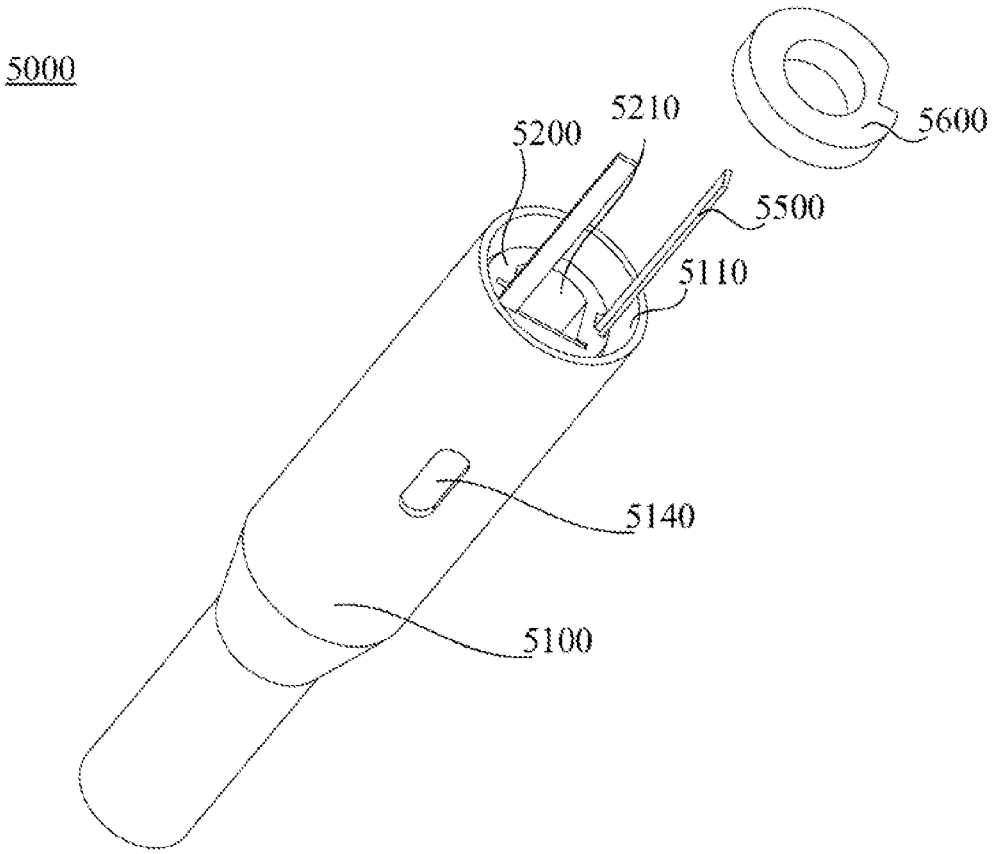
FIG. 29 is a perspective view of an atomizing core according to some other embodiments of the present disclosure.

FIG. 29 shows an atomizing core 5000 according to some other embodiments of the present disclosure. Features of the atomizing core 5000 in FIG. 5 are substantially the same as those of the atomizing core 4000 in FIGS. 22-28.

Different from the atomizing core housing 4100 (with two atomizing substrate inlets 4140) in the atomizing core 4000, one atomizing substrate inlet 5140 is arranged on an atomizing core housing 5100 of the atomizing core 5000.

Moreover, the atomizing core 5000 may further include a leak-proof material 5600. The leak-proof material 5600 is arranged between electrodes 5500 and the atomizing core housing 5100 and abuts against an end of the atomizing seat 5200 proximate to an airflow inlet 5110, to further prevent liquid leakage at the bottom of the atomizing core. In some embodiments, after glue is applied among the electrodes 5500, the atomizing core housing 5100, and the end of the atomizing seat 5200 proximate to the airflow inlet 5110, the leak-proof material 5600 may be stuffed between the atomizing core housing 5100 and the electrodes 5500 at the airflow opening 5110 and abut against the end of the atomizing seat 5200 proximate to the airflow inlet 5110, to further promote a leak-proof effect.

The leak-proof material 5600 may be made of cotton, etc. A shape of the leak-proof material may match that of the atomizing core housing (for example, both are circular, etc.) so as to be embedded in the atomizing core housing. Furthermore, an outer diameter of the leak-proof material 5600 may be slightly greater than an inner diameter of the atomizing core housing, such that the leak-proof material may be embedded in the atomizing core housing by an interference fit, so as to promote the leak-proof effect.

A portion of the leak-proof material 5600 opposite the atomizing channel 5210 may be provided with an opening, such that the airflow at the airflow inlet may pass through the opening into the atomizing channel.

It is to be understood herein that besides the features described above, other features of the atomizing core 5000 (for example, features of the atomizing core housing 5100, other features of the electrode 5500, etc.) may be the same as the corresponding features of the atomizing core 4000 described in FIGS. 22-28 and will not be described in detail herein for the sake of brevity. Moreover, it may be understood that for the atomizing core according to one or more of the embodiments described above, a leak-proof material that is the same or similar to the leak-proof material 5600 described in FIG. 29 may be provided.

Figure 30:
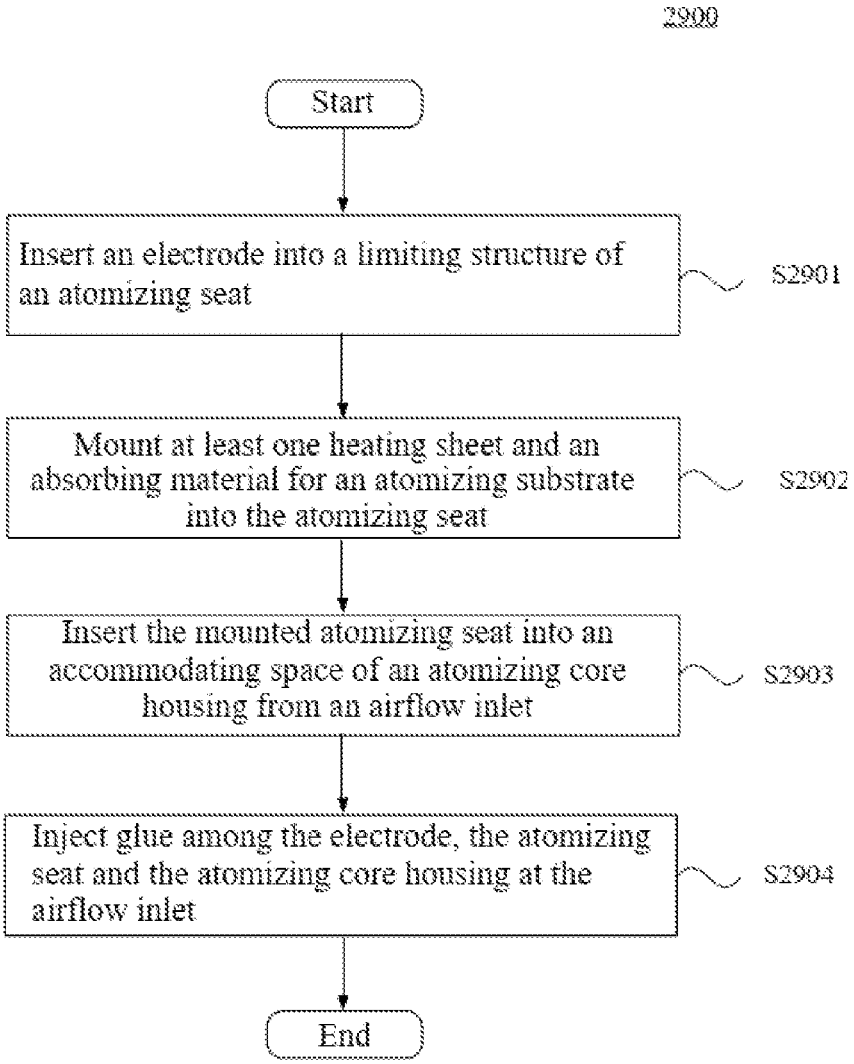
FIG. 30 shows an assembly method for an atomizing core according to some embodiments of the present disclosure.

According to yet another aspect of the present disclosure, an assembly method 2900 for an atomizing core 1000, 2000, 3000, 4000, or 5000 is provided. As shown in FIG. 30, the assembly method 2900 may include: S2901, inserting an electrode into a limiting structure of an atomizing seat; S2902, mounting at least one heating sheet and an absorbing material for an atomizing substrate into the atomizing seat; S2903, inserting the mounted atomizing seat into an accommodating space of an atomizing core housing from an airflow inlet of the atomizing core housing; and S2904, injecting glue among the electrode, the atomizing seat and the atomizing core housing at the airflow inlet.

In some examples, the assembly method 2900 may further include: mounting a leak-proof material on an end of the atomizing seat proximate to the airflow inlet. For example, after the glue is injected, the leak-proof material is mounted on the end of the atomizing seat proximate to the airflow inlet. The leak-proof material is arranged between the electrodes and the atomizing core housing and abuts against the end of the atomizing seat proximate to the airflow inlet.

Although the various operations are depicted in the drawings in a particular order, this should not be understood as requiring that these operations must be performed in the particular order shown or in a sequential order, nor should it be understood as requiring that all operations shown must be performed to obtain the desired result. For example, S2902 may be executed before S2901. For another example, mounting of the heating sheet or mounting of the absorbing material for the atomizing substrate in S2902 may be executed before S2901.

In the case that the atomizing core is the atomizing core 1000 in FIGS. 1-8, the assembly method 2900 includes, for example: inserting the electrodes 1500 into the limiting structure 1240 (specifically, the limiting channel 1241) of the atomizing seat 1200; mounting the heating sheet 1300 and the absorbing material 1400 for the atomizing substrate in the atomizing seat 1200 in sequence, for example, inserting the heating sheet into the atomizing seat 1200 from an upper portion of the atomizing seat 1200 as shown in FIG. 7, and embedding the absorbing material 1400 for the atomizing substrate in the opening 1220; inserting the mounted atomizing seat 1200 into the accommodating space 1130 of the atomizing core housing 1100 from the airflow inlet 1110; and injecting glue among the electrodes 1500, the atomizing seat 1200 and the atomizing core housing 1100 at the airflow inlet 1110. In some examples, the electrodes may be mounted prior to the heating sheet. In this case, the electrodes may serve as a support for the heating sheet.

In the case that the atomizing core is the atomizing core 2000 in FIGS. 9-11, the assembly method 2900 includes, for example: inserting the electrodes 2500 into the limiting structure 2240 (specifically, the limiting channel 2241) of the atomizing seat 2200; mounting a first heating sheet 2300, a second heating sheet 2300', a first absorbing material 2400 for the atomizing substrate and a second absorbing material 2400' for the atomizing substrate in the atomizing seat 2200, for example, inserting the first heating sheet and the second heating sheet into the atomizing seat 2200 from an upper portion of the atomizing seat 2200 as shown in FIG. 10, and embedding the first absorbing material for the atomizing substrate and the second absorbing material for the atomizing substrate in the first opening 2220 and the second opening 2220' respectively; inserting the mounted atomizing seat 2200 into the accommodating space 2130 of the atomizing core housing 2100 from the airflow inlet 2110; and injecting glue among the electrodes 2500, the atomizing seat 2200 and the atomizing core housing 2100 at the airflow inlet 2110. In some examples, the electrodes may be mounted prior to the heating sheet. In this case, the electrodes may serve as a support for the heating sheet.

In the case that the atomizing core is the atomizing core 3000 in FIGS. 12-21, the assembly method 2900 includes, for example: mounting the heating sheet 3300 and the absorbing material 3400 for the atomizing substrate in the atomizing seat 3200, for example, from the opening 3220, such that the heating sheet 3300 abuts against the ramp 3242 of the limiting structure 3240; inserting the electrodes 3500 into the limiting structure 3240 (specifically, the limiting channel 3241) of the atomizing seat 3200, such that the electrodes 3500 contact the electrode contacts on the heating sheet 3300; inserting the mounted atomizing seat 3200 into the accommodating space 3130 of the atomizing core housing 3100 from an airflow inlet 3110; and injecting glue among the electrode 3500, the atomizing seat 3200 and the atomizing core housing 3100 at the airflow inlet 3110. It may be understood that the order of mounting the heating sheet, the absorbing material for the atomizing substrate and the electrodes may vary, for example, the step of mounting the electrodes may be followed by the step of mounting the heating sheet and the absorbing material for the atomizing substrate, which is not limited thereto.

Figure 26:
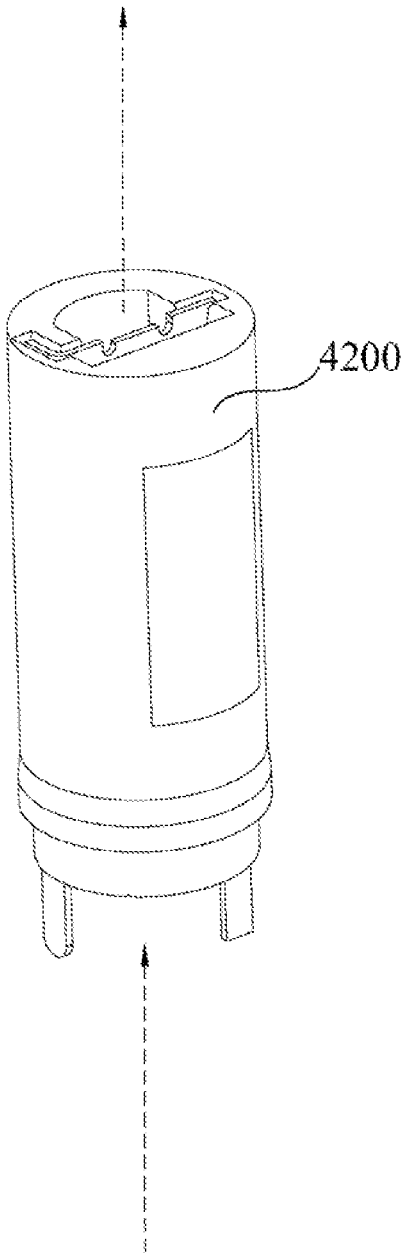
FIG. 26 is a perspective view of an atomizing seat of the atomizing core in FIG. 22.

In the case that the atomizing core is the atomizing core 4000 in FIGS. 22-28, the assembly method 2900 includes, for example: inserting the first electrode 4510 into the first limiting channel 4241 of the atomizing seat 4200 from the first end surface of the atomizing seat 4200 proximate to the airflow inlet 4110, and inserting the second electrode 4510' into the second limiting channel 4241' of the atomizing seat 4200 from the second end surface of the atomizing seat 4200 facing away from the airflow inlet 4110; mounting the heating sheet 4300 and the absorbing material 4400 for the atomizing substrate in the atomizing seat 4200, for example, inserting the heating sheet into the atomizing substrate 4200 from an upper portion of the atomizing seat 4200 as shown in FIG. 26, and embedding the absorbing material 4400 for the atomizing substrate in the opening 4220; inserting the mounted atomizing seat 4200 into the accommodating space 4130 of the atomizing core housing 4100 from the airflow inlet 4110; and injecting glue among the first electrode 4510, the second electrode 4520, the atomizing seat 4200 and the atomizing core housing 4100 at the airflow inlet 4110. In some examples, the electrodes may be mounted prior to the heating sheet. In this case, the electrodes may serve as a support for the heating sheet.

Through the method according to one or more embodiments of the present disclosure, laborious manual operations in cotton and ceramic heating cores in the related art are avoided, and automated operations can be achieved, so as to improve production efficiency and product stability.

Figure 31:
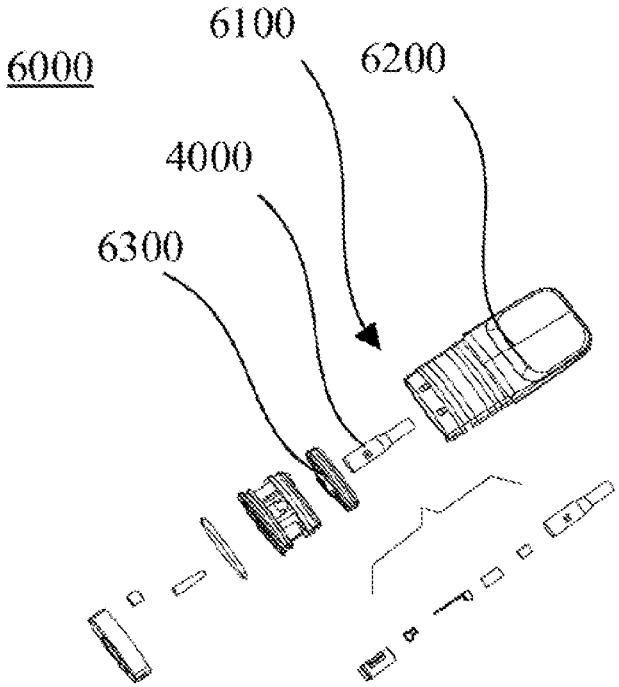
FIG. 31 is a schematic diagram of an atomizing core according to some embodiments of the present disclosure.

According to still another aspect of the present disclosure, an atomizer is provided. The atomizer includes: an atomizing core 1000, 2000, 3000, 4000, 5000 according to one or more of the embodiments described above; and a housing, where the atomizing core is arranged in the housing, and a storage chamber for storing an atomizing substrate is formed between an inner wall of the housing and an outer wall of the atomizing core. Specifically, for example, as shown in FIG. 31, the atomizer 6000 may include the above-described atomizing core 4000 and a housing 6100.

The housing 6100 of the atomizer includes a housing body 6200 and a base 6300. The atomizing core is arranged in the housing body 6200, and the storage chamber is defined by a space among an inner wall of the housing body 6200, the base 6300 and an outer wall of an atomizing core housing of the atomizing core.

According to still another aspect of the present disclosure, an electronic cigarette is provided. The electronic cigarette includes: the atomizer described above; and a power supply assembly to supply power to the atomizer (for example, a battery).

According to still another aspect of the present disclosure, an assembly method for an electronic cigarette is provided. The assembly method includes: assembling an atomizing core according to the assembly method for an atomizing core of one or more of the embodiments described above; mounting the atomizing core in a housing of an atomizer, to form the atomizer; and connecting the atomizer to a power supply assembly, for example by means of a magnet at the bottom, to form the electronic cigarette.

The above are merely embodiments or examples of the present disclosure and thus do not limit the patent scope of the present disclosure, and equivalent structural transformation made by utilizing the contents of the specification and accompanying drawings of the present disclosure, or direct/indirect application in other related technical fields fall within the scope of protection of claims of the present disclosure under the inventive concept of the present disclosure. Various elements in the embodiments or examples may be omitted or substituted by equivalent elements thereof. Moreover, the steps may be performed in an order different from that described in the present disclosure. Further, various elements in the embodiments or examples may be combined in various ways. It is important that, as the technology evolves, many elements described herein may be replaced with equivalent elements that appear after the present disclosure.

What is claimed is:

1. An atomizing core for atomizing an atomizing substrate to form an aerosol, comprising:

an atomizing core housing defining an airflow inlet, an airflow outlet, an accommodating space between the airflow inlet and the airflow outlet, and at least one atomizing substrate inlet in communication with the accommodating space;

an atomizing seat arranged in the accommodating space and defining an atomizing channel for being in communication with the airflow inlet and the airflow outlet, and at least one opening for communicating the at least one atomizing substrate inlet with the atomizing channel; and at least one heating sheet arranged in the atomizing channel and at least partially opposite one or more of the at least one opening, respectively, wherein a respective first surface of the at least one heating sheet rests against an inner wall of the atomizing seat.

2. The atomizing core according to claim 1, wherein:

the at least one atomizing substrate inlet includes at least one first atomizing substrate inlet and at least one second atomizing substrate inlet, the first atomizing substrate inlet and the second atomizing substrate inlet being formed in two opposing side walls of the atomizing core housing, respectively;

the at least one opening includes a first opening and a second opening, the first opening and the second opening being formed in two opposing side walls of the atomizing seat, respectively; and the at least one heating sheet includes a first heating sheet and a second heating sheet, the first heating sheet being at least partially opposite the first opening, and the second heating sheet being at least partially opposite the second opening, to enable the atomizing substrate to achieve at least one of the following: reaching the first heating sheet through the at least one first atomizing substrate inlet and the first opening, or reaching the second heating sheet through the at least one second atomizing substrate inlet and the second opening.

3. The atomizing core according to claim 1, wherein the at least one heating sheet is parallel to a longitudinal extension direction of the atomizing channel, and a glue is provided for sealing between the inner wall of the atomizing seat and the first surface.

4. The atomizing core according to claim 1, wherein the at least one heating sheet is angled with respect to a longitudinal extension direction of the atomizing channel.

5. The atomizing core according to claim 1, wherein the at least one heating sheet each is of a sheet structure provided with a plurality of micropores for adsorbing the atomizing substrate by a capillary action.

6. The atomizing core according to any one of claim 1, wherein an absorbing material for the atomizing substrate is arranged in each of the at least one opening, the absorbing material for the atomizing substrate having a first side surface and a second side surface opposite the first side surface, the first side surface covering the atomizing substrate inlet opposite the absorbing material for the atomizing substrate from an inner side of the atomizing core housing, and the second side surface resting against the heating sheet opposite the absorbing material for the atomizing substrate.

7. The atomizing core according to any one of claim 1, wherein a projection is arranged on a peripheral side surface of the atomizing seat, the projection being located between the at least one opening and the airflow outlet, as seen in a longitudinal extension direction of the atomizing core, and abutting against an inner wall of the atomizing core housing.

8. The atomizing core according to any one of claim 1, wherein a respective second surface of the at least one heating sheet facing away from the inner wall of the atomizing seat is provided with a plurality of electrode contacts, and the atomizing core further includes a plurality of electrodes for contacting the plurality of electrode contacts.

9. The atomizing core according to claim 8, wherein the atomizing seat further defines a limiting structure including a plurality of limiting channels, and the plurality of electrodes each are inserted into one of the plurality of limiting channels, to contact one of the plurality of electrode contacts.

10. The atomizing core according to claim 9, wherein each electrode of the plurality of electrodes has a first protrusion for abutting against an inner wall of the limiting channel where the electrode is inserted.

11. The atomizing core according to claim 9, wherein a first limiting channel of the plurality of limiting channels extends inwardly from a first end surface of the atomizing seat proximate to the airflow inlet.

12. The atomizing core according to claim 11, wherein the first limiting channel includes a first limiting portion arranged proximate to the heating sheet, and a second limiting portion formed by the first end surface of the atomizing seat proximate to the airflow inlet, and a first electrode of the plurality of electrodes has a first end abutting against the first limiting portion, and a second protrusion abutting against the second limiting portion.

13. The atomizing core according to claim 11, wherein a second limiting channel of the plurality of limiting channels extends inwardly from a second end surface of the atomizing seat opposite the first end surface.

14. The atomizing core according to claim 13, wherein:

a first electrode of the plurality of electrodes has a first bent portion in an intermediate position of the first electrode, and a second electrode of the plurality of electrodes has a second bent portion in an end position of the second electrode;

the first limiting channel includes a third limiting portion being of a stepped structure and proximate to the heating sheet, and the first bent portion abuts against the third limiting portion; and the second limiting channel includes a fourth limiting portion formed by the second end surface of the atomizing seat, and the second bent portion abuts against the fourth limiting portion.

15. The atomizing core according to any one of claim 9, wherein the limiting structure further includes at least one ramp, and the second surface of the at least one heating sheet facing away from the inner wall of the atomizing seat rests against the at least one ramp.

16. The atomizing core according to claim 8, wherein a glue is provided for enclosing among the electrodes, an end of the atomizing seat proximate to the airflow inlet, and the atomizing core housing.

17. The atomizing core according to claim 8, further comprising a leak-proof material arranged between the electrodes and the atomizing core housing and abutting against an end of the atomizing seat proximate to the airflow inlet.

18. An atomizer, comprising:

an atomizing core according to claim 1; and a housing, wherein the atomizing core is arranged in the housing, and a storage chamber for storing an atomizing substrate is formed between the housing and the atomizing core.

19. An electronic cigarette, comprising:

an atomizer according to claim 18; and a power supply assembly to supply power to the atomizer.

20. An assembly method for an atomizing core according to claim 1, wherein the atomizing core further includes an electrode and an absorbing material for an atomizing substrate, and the atomizing seat defines a limiting structure for inserting the electrode therein, the assembly method comprising:

inserting the electrode into the limiting structure of the atomizing seat;

mounting the at least one heating sheet and the absorbing material for the atomizing substrate into the atomizing seat;

inserting the mounted atomizing seat into an accommodating space of the atomizing core housing from the airflow inlet; and injecting glue among the electrode, the atomizing seat and the atomizing core housing at the airflow inlet.

21. An atomizing core for atomizing an atomizing substrate to form an aerosol, comprising:

an atomizing core housing defining an airflow inlet, an airflow outlet, an accommodating space between the airflow inlet and the airflow outlet, and at least one atomizing substrate inlet in communication with the accommodating space;

an atomizing seat arranged in the accommodating space and defining an atomizing channel for being in communication with the airflow inlet and the airflow outlet, and at least one opening for communicating the at least one atomizing substrate inlet with the atomizing channel; and at least one heating sheet arranged in the atomizing channel and at least partially opposite one or more of the at least one opening, respectively;

wherein an absorbing material for the atomizing substrate is arranged in each of the at least one opening.

22. An atomizing core for atomizing an atomizing substrate to form an aerosol, comprising:

an atomizing core housing defining an airflow inlet, an airflow outlet, an accommodating space between the airflow inlet and the airflow outlet, and at least one atomizing substrate inlet in communication with the accommodating space;

an atomizing seat arranged in the accommodating space and defining an atomizing channel for being in communication with the airflow inlet and the airflow outlet, at least one opening for communicating the at least one atomizing substrate inlet with the atomizing channel, and a radially inward facing surface; and at least one heating sheet arranged in the atomizing channel and engaged with the radially inward facing surface.

* * * * *